US006991561B2

(12) United States Patent
Nesbitt et al.

(10) Patent No.: US 6,991,561 B2
(45) **Date of Patent: *Jan. 31, 2006**

(54) GOLF BALL HAVING A CONTROLLED VARIABLE MOMENT OF INERTIA AND METHOD OF MAKING SAME

(75) Inventors: R. Dennis Nesbitt, Hernando, FL (US); Mark L. Binette, Ludlow, MA (US); Thomas A. Veilleux, Charlton, MA (US)

(73) Assignee: Callaway Golf Company, Carlsbad, CA (US)

( * ) Notice: Subject to any disclaimer, the term of this patent is extended or adjusted under 35 U.S.C. 154(b) by 80 days.

This patent is subject to a terminal disclaimer.

(21) Appl. No.: 10/875,487

(22) Filed: Jun. 24, 2004

(65) Prior Publication Data

US 2005/0003906 A1 Jan. 6, 2005

Related U.S. Application Data

(63) Continuation-in-part of application No. 10/015,527, filed on Dec. 13, 2001, now Pat. No. 6,755,753.

(51) Int. Cl.
*A63B 37/06* (2006.01)

(52) U.S. Cl. ..... 473/355

(58) Field of Classification Search ..... 473/355, 473/375, 377, 570, 594, 253, 358; 273/DIG. 20
See application file for complete search history.

(56) References Cited

U.S. PATENT DOCUMENTS 728,311 A 5/1903 Singer
737,031 A 8/1903 Short
765,145 A 7/1904 Manahan
906,664 A 12/1908 Smith
1,120,757 A 12/1914 Steinberger
2,219,154 A 10/1940 Wahlberg
2,277,057 A 3/1942 Bach
2,499,483 A 3/1950 Foy
2,859,968 A 11/1958 Modica, Jr.
3,262,700 A 7/1966 Miller
3,874,663 A 4/1975 Kahle
3,954,269 A 5/1976 Brittingham
4,058,310 A 11/1977 Mietlinen
4,194,737 A 3/1980 Farmer
4,332,102 A 6/1982 Caffrey
4,609,196 A 9/1986 Bozinovic
4,664,387 A 5/1987 Tardiff (Continued)

*Primary Examiner*—Raeann Gorden
(74) *Attorney, Agent, or Firm*—Michael A. Catania; Elaine H. Lo

(57) ABSTRACT

A golf ball is provided having a controlled variable moment of inertia. The golf ball includes a core defining at least one hollow channel. At least one movable weight is located within each hollow channel. The end of the hollow channel at the outer edge of the core is enclosed with a plug. The movable weight and plug may each further include a magnet or the hollow channel may include a placement member such as a spring to control the movement of the weight. When the present golf ball is struck, the spin rate forces the weights to move from the interior of the core outwardly towards the outer edge of the core, thereby varying the moment of inertia of the golf ball. A method of manufacturing the present golf ball is also provided. The golf ball also significantly reduces hooks and slices due to the gyroscopic effect of the moving weight(s) to the outer edge of the core.

18 Claims, 13 Drawing Sheets

U.S. PATENT DOCUMENTS

| | | | | |
|---|---|---|---|---|
| 4,974,511 | A | 12/1990 | Hsi-Chou | |
| 5,026,067 | A | 6/1991 | Gentiluomo | |
| 5,358,448 | A | 10/1994 | Stephens | |
| 5,779,562 | A | 7/1998 | Melvin et al. | |
| 5,779,563 | A | 7/1998 | Yamagishi et al. | |
| 5,779,564 | A | 7/1998 | Nakamura et al. | |
| 5,792,009 | A | 8/1998 | Maruko | |
| 5,807,192 | A | 9/1998 | Yamagishi et al. | |
| 5,846,141 | A | 12/1998 | Morgan et al. | |
| 5,876,294 | A | 3/1999 | Yamagishi et al. | |
| 5,899,822 | A | 5/1999 | Yamagishi et al. | |
| 6,004,225 | A | 12/1999 | Owens et al. | |
| 6,010,412 | A | 1/2000 | Moriyama | |
| 6,045,460 | A | 4/2000 | Hayashi et al. | |
| 6,048,279 | A | 4/2000 | Masutani | |
| 6,142,887 | A | 11/2000 | Sullivan et al. | |
| 6,174,247 | B1 | 1/2001 | Higuchi et al. | |
| 6,180,722 | B1 | 1/2001 | Dalton et al. | |
| 6,755,753 | B2 * | 6/2004 | Nesbitt et al. | 473/355 |
| 6,852,784 | B2 * | 2/2005 | Sullivan | 524/322 |

* cited by examiner

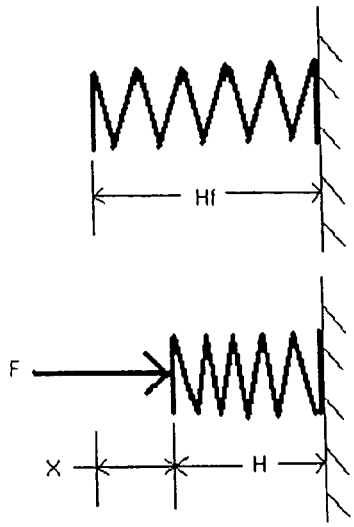
Figure 21 - Force Acting on a Spring (General Case)
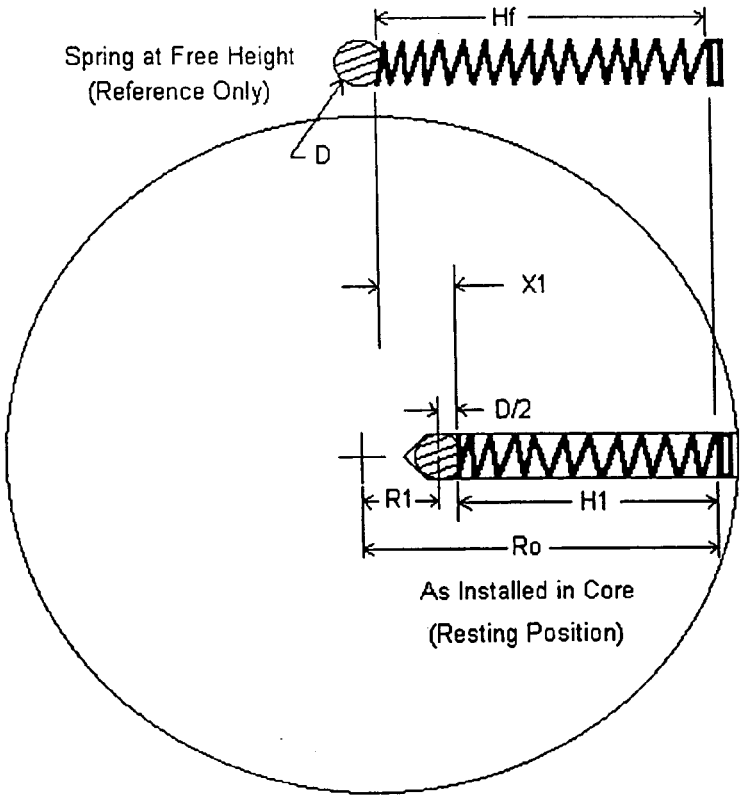
Figure 22 - Preload Force Acting on the Moveable Weight in Resting Position

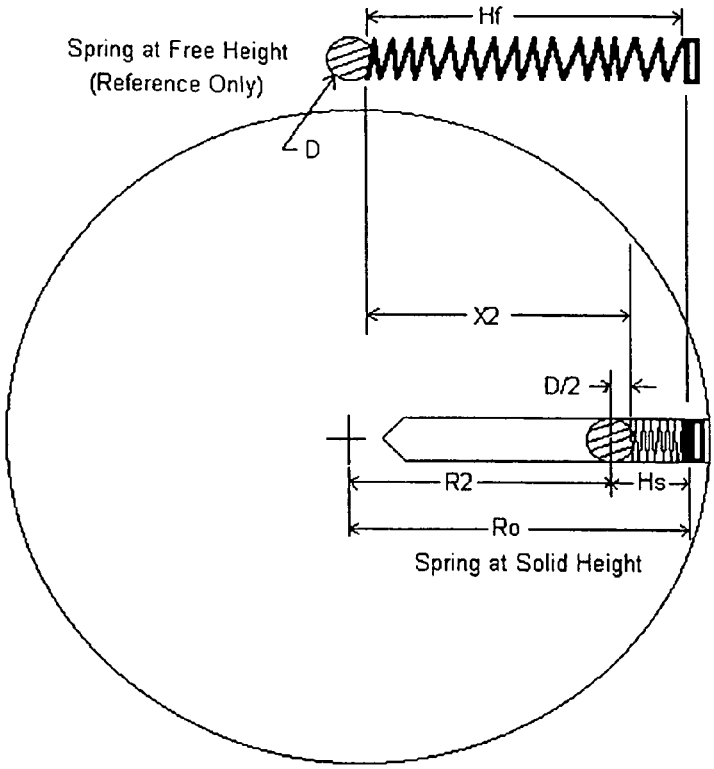
Figure 23 - Spring Force Acting on the Moveable Weight at Solid Height

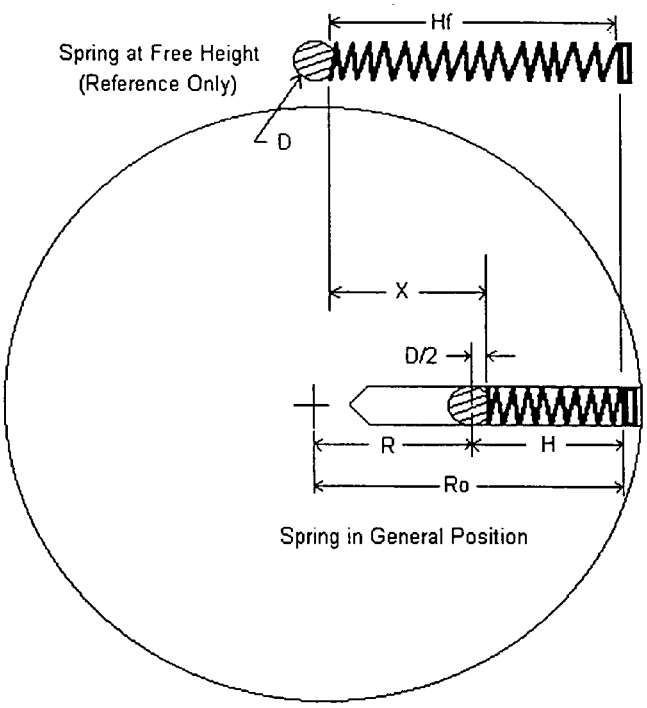
Figure 24 - Spring Force Acting on the Moveable Weight at a General Position
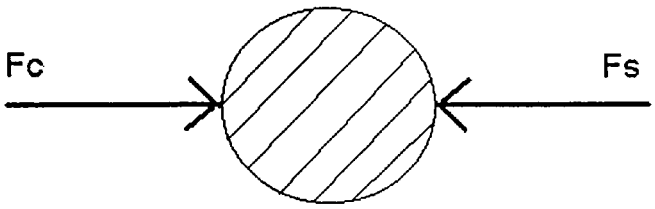
Figure 25 - Forces Acting on the Moveable Weight

GOLF BALL HAVING A CONTROLLED VARIABLE MOMENT OF INERTIA AND METHOD OF MAKING SAME

CROSS REFERENCE TO RELATED APPLICATIONS

This application is a continuation-in-part of U.S. application Ser. No. 10/015,527, filed Dec. 13, 2001 now U.S. Pat. No. 6,755,753.

FIELD OF THE INVENTION

The present invention is directed to a golf ball having a controlled variable moment of inertia. Particularly, the golf ball includes at least one hollow channel. At least one movable weight is located in the hollow channel near the center of the golf ball at rest, and moves outwardly as the spin rate of the ball increases. The movable weight returns towards the center of the golf ball as the spin rate decreases. The change in the radial position of the movable weight alters the moment of rotational inertia of the ball. The position of the weight within the channel is controlled, such as by a spring or spring-like device, magnetic force, etc. The present invention is also directed to a method for making a golf ball having a controlled variable moment of inertia.

BACKGROUND OF THE INVENTION

Moment of inertia is the sum of the products formed by multiplying the mass of each part of an assembly by the square of its distance from a specified axis plus the moment of inertia of each part about its own center of mass. It is also sometimes referenced as rotational inertia. In spherical objects, such as a golf ball, a low moment of inertia means that a larger portion of its mass is concentrated in the center. In turn, a high moment of inertia means that more of its mass is concentrated towards the outer cover or periphery of the sphere or ball.

Moment of inertia ("MOI") affects the playability of a golf ball in many ways. For example, moment of inertia affects the amount of spin produced when the golf ball is struck with a wood or iron. This may result in a desirable characteristic (i.e. high spin for ball placement, low spin for enhanced distance, etc.) or an undesirable characteristic (i.e. hooking or slicing, etc.) depending upon the skill level of the golfer, the type of club used, etc. Moment of inertia also affects the overall trajectory of a ball and thus, often the overall distance the ball will travel. Also, moment of inertia affects the short game, including lofting, pitching, chipping, and putting.

For some aspects of the golf game, it is desirable to have a golf ball that exhibits a relatively high moment of rotational inertia, for example in which the mass of the ball located near the outer periphery of the ball is greater than the mass of the ball located near the center of the ball. A golf ball exhibiting a high moment of inertia generally has a reduced rate of spin, including reduced side spin, so that such a ball may be desired for certain shots requiring distance. A low spin ball also produces less side spin, thus reducing the amount of hooking and slicing.

Although a golf ball exhibiting a relatively high moment of inertia has certain desirable properties at different club head speeds and with different lofted clubs, it may also possess undesirable characteristics. Furthermore, such a ball may lack the necessary feel and roll characteristics for the short game, particularly putting.

Therefore, for certain aspects of the golf game, it would be desirable for a golf ball to exhibit a relatively low moment of inertia, where the mass of the ball near the center of the ball is greater than the mass of the ball near the outer portion of the ball. As noted, in some applications, a golf ball exhibiting a relatively low moment of inertia is desirable, such as for the short game where high spin allows a skilled golfer to more easily position his/her ball on the green, etc. In turn, it is also desirable in certain situations for a golf ball to exhibit a relatively high moment of inertia, such as for the long game where enhanced distance is desirable.

Currently, golf balls having a relatively low or high fixed moment of inertia are commercially available or are known in the art. For example, U.S. Pat. No. 5,026,067 teaches a golf ball having a cover or intermediate layer with a specific gravity greater than the center, giving the golf ball a relatively high moment of inertia. Also, U.S. Pat. No. 6,010,912 teaches a golf ball having a low specific gravity core and a high specific gravity layer surrounding the core so that the golf ball has a relatively high moment of inertia. Conversely, U.S. Pat. No. 6,180,722 teaches a golf ball having a specific gravity near the center of the ball greater than the layer surrounding the center so that such a ball has a relatively low moment of inertia.

Players, depending upon their skill and preferences relating to the features of a golf ball, may choose a golf ball having a relatively high moment of inertia in order to increase distance and/or reduce the amount of slicing or hooking when driving, or a golf ball having a relatively low moment of inertia for improved feel, placement, etc., near or on the green. Unfortunately, a golfer choosing either a high or low moment of inertia golf ball in order to promote certain aspects of the game risks suffering deficiencies in other aspects of the game.

In the past, golf and/or game balls have been formed where the movement of inertia of the ball randomly varies. U.S. Pat. No. 1,120,757 discloses a game ball having a spherical ball that randomly moves within the chambers of the game ball when the game ball rotates. The springs described in that patent are used to ensure that the spherical ball does not maintain a position near the outer periphery of the game ball. That is, the springs cause the spherical ball to rebound from the outer periphery of the game ball toward the center of the game ball, thereby preventing the spherical ball from remaining in one chamber while the game ball is in action. The design of the game ball in the '757 patent causes the center of gravity, also known as the center of mass, of the game ball to randomly vary as the game ball rotates as a result of the random movement of the spherical ball within the interior of the game ball. This design causes peculiar gyration and movement of the game ball along paths that are impossible to determine with any degree of accuracy.

U.S. Pat. Nos. 728,311; 737,032; and 2,859,968 are directed to various balls that have a hollow portion in the center of the ball and one or more smaller balls within the hollow portion. When the ball rotates, the smaller ball or balls in the hollow portion freely moves in an uncontrolled fashion within the ball. None of the balls disclosed in these patents has a controlled variable moment of inertia which would maximize the playability and feel desired in a golf ball.

Accordingly, it would be useful to develop a golf ball having a controlled variable moment of inertia such that the golf ball exhibits low moment of inertia properties that are desirable during short distance play and also exhibits high moment of inertia properties that are desirable during longer distance play. In particular, it would be desirable to provide a golf ball having a moment of rotational inertia that may be selectively varied. It would also be desirable to provide a golf ball that has excellent durability.

SUMMARY OF THE INVENTION

Accordingly, it is a feature of the present invention to provide a golf ball having a controlled variable moment of inertia. In a first aspect of the present invention, a golf ball is provided which has at least one hollow channel. At least one end of the hollow channel is located along the outer periphery of the ball. At least one movable weight is located in the hollow channel. A positioning member such as a spring, which is in constant contact with the movable weight, controls the movement and position of the weight within the hollow channel. A plug encloses the end of the hollow channel along the outer edge of the ball. The golf ball is preferably formed from a material that has excellent durability.

In a second aspect, the present invention provides a golf ball comprising a core defining at least one hollow channel. The hollow channel has at least one end at the outer edge of the core. At least one movable weight comprising a magnet is located in the hollow channel. A plug also comprising a magnet encloses the end of the hollow channel at the outer edge of the core. The magnetic polarity of the end or face of the movable weight nearest the plug is the same as the portion of the plug nearest the weight. The golf ball is preferably formed from a material that has excellent durability.

In another aspect, the present invention provides a golf ball having a core defining at least one hollow channel. The hollow channel has at least one end at the outer edge of the core. At least one movable weight and a spring in continuous contact with the weight are located in the hollow channel. A plug encloses the end of the hollow channel at the outer edge of the core. The movable weight is positioned between the spring and plug. The golf ball is preferably formed from a material that has excellent durability.

In an additional aspect, the present invention provides a golf ball having a moment of rotational inertia that changes depending upon the spin rate of the ball. The golf ball preferably comprises a generally spherical core which defines one or more radially extending channels within the interior of the core. The ball further preferably comprises one or more spherical components, each positioned and movable within a respective channel. The ball also comprises one or more springs, each also positioned in a respective channel and in continuous contact with a corresponding spherical component. Upon sufficient rotation of the ball, each of the spherical components is displaced radially outward within a corresponding channel, thereby altering the moment of rotational inertia of the ball. The golf ball is preferably formed from a material that has excellent durability.

In a further aspect, the present invention provides one or more methods for promoting particular types of spin to a golf ball. In these techniques, a golf ball according to the present invention is positioned on a hitting surface such as a golf tee so that particular interior components of the ball are oriented in either a generally horizontal or vertical plane.

In yet another aspect, the present invention provides a method for making a golf ball having a controlled variable moment of inertia. The method includes preparing a ball; drilling into the ball from the outer edge to form at least one hollow channel; inserting at least one movable weight into the hollow channel; inserting a spring into the hollow channel that is in continuous contact with the weight; and enclosing the end of the hollow channel at the outer edge of the ball with a plug.

These and other objects and features of the invention will be apparent from the detailed description set forth below.

BRIEF DESCRIPTION OF THE DRAWINGS

The present invention will become more fully understood from the detailed description given below and the accompanying drawings. The description and drawings are given by way of illustration only, and thus do not limit the present invention.

FIG. 21 depicts a general case of the force acting on a spring including an unloaded spring with no forces acting on it, and a loaded spring with external force F.

FIG. 22 depicts a preload force acting on a moveable weight in resting position.

FIG. 23 depicts a spring force acting on a moveable weight at solid height.

FIG. 24 depicts a spring force acting on a moveable weight at a general position.

FIG. 25 depicts the forces acting on a moveable weight.

DETAILED DESCRIPTION OF THE PREFERRED EMBODIMENTS

Figure 1A:
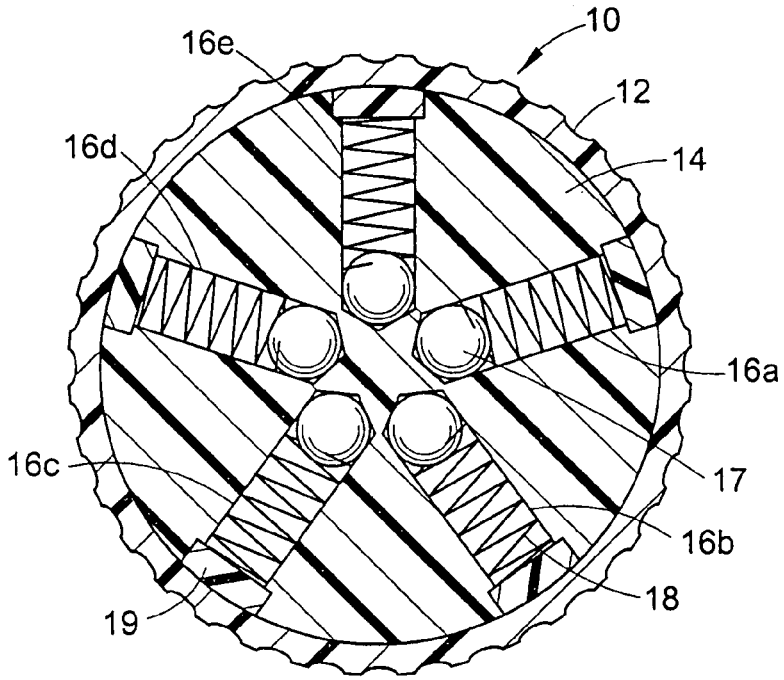
FIG. 1A depicts a cross-sectional view of a golf ball including a core defining five hollow channels, a movable weight and a compression spring within each hollow channel, a plug enclosing the end of each hollow channel at the outer edge of the core, and a cover disposed about the core.

Generally, the preferred embodiment in accordance with the present invention is a golf ball having at least one hollow channel radially extending between the center and the outer edge or periphery of the ball, at least one movable weight located in the hollow channel, and a plug enclosing the end of the channel at the outer edge of the ball. The movement or position of the movable weight within the channel is controlled by a positioning means or member, such as a spring or by a magnetic force. At rest, the positioning member maintains the position of the movable weight toward the center of the ball.

Preferably, the positioning member is a mechanical spring. Such a spring is generally an elastic, stressed, stored-energy machine element that, when released, will recover its basic form or position. Force applied to a spring member causes it to deflect through a certain displacement thus absorbing energy. Mechanical springs can be manufactured to various amounts of force needed for displacement.

The spring utilized in the present invention is preferably a helical or a spiral spring made from any elastic material to produce the displacement force desired. The springs are oriented to return the displaced moveable weights to their original position. Different tensioned springs can be utilized in the invention depending upon the number of channels utilized, the mass of the moveable weight, the amount of centrifugal force desired to be overcome, etc.

In this regard, upon striking or hitting the ball of the present invention with a golf club, spin is imparted to the ball. Spinning of the ball causes the movable weight to move radially outward toward the periphery of the ball. Such spinning causes the weight to exert centrifugal force on the positioning member, such as the spring, thereby either compressing or tensioning the spring, depending upon the relative location of the spring to the weight and the spring constant of the positioning member.

Specifically, as the movable weight moves toward the outer region of the ball, the moment of rotational inertia of the ball increases and the positioning member becomes compressed or tensioned. As the spin rate of the golf ball decreases, the positioning member forces the movable weight to return toward the center of the ball, thereby decreasing the moment of inertia. The positioning member, such as the spring or spring-like device that is in continuous contact with the movable weight is employed to return the movable weight toward or near the center of the ball once the force of the spring is greater than the centrifugal force. Alternatively, the movable weight and plug comprise magnets that are oriented with respect to each other such that opposing magnetic poles maintain or return the movable weight near the center of the ball upon a sufficiently low centrifugal force. Further positioning means or members may also be utilized to position the movable weight member near the center of the ball upon a sufficiently predetermined low centrifugal force. The golf ball may be a one-piece golf ball, a two-piece golf ball, or a multi-layer golf ball.

A significant advantage of a golf ball having a controlled variable moment of inertia is that when the golf ball is at rest or spinning slowly, it has a relatively low moment of inertia, thereby enabling the ball to roll easily. Upon relatively large impact hits with high club head speed, such as with a driver or certain irons, the ball reaches a sufficient minimum spin rate. At that time, the centrifugal force causes the movable weights to overcome the set spring constant of the positioning members. The moveable weights are then radially and outwardly displaced within their respective channels, thereby increasing the moment of inertia of the ball. A golf ball having a relatively high moment of inertia has less spin, resulting in less hooking or slicing and/or longer overall distance. It will be appreciated that the terms "moment of rotational inertia" and "moment of inertia" are used interchangeably herein unless noted otherwise.

As the centrifugal force decreases, the positioning members force the movable weights back to their original placement in the channels. That is, when the spring force of the positioning members becomes greater than the centrifugal force, the movable weights start moving back to their original positions thereby again reducing the moment of inertia of the ball.

A mathematical model can be developed to describe the relationship between golf ball spin rate and the position of the moveable weight. In addition, there is a relationship for mass moment of inertia as a function of spin rate.

A spring resists deflection with a force proportional to the deflection from its free or unloaded height. The constant of proportionality is called the spring constant, K. Therefore, the force is shown in equation 1:

$$F=K\cdot X \tag{1}$$

In equation 1, F is force, K is the spring constant, and X is the deflection from free height or change in spring length. In general, an unloaded spring with no external forces acting upon it, has a free height of $H_f$. When the spring is loaded with force F, the height is changed to a new height H (see FIG. 21). The value of the force F can be determined as follows. First, solve for the deformation X, as the spring force is dependent upon the spring deformation, not the new height. Therefore, $$X=H-H_f \tag{2}$$

Since, $F=K\cdot X$, and $X=H-H_f$, then $$F=K\cdot[H-H_f] \tag{3}$$

From the above, when $H=H_f$, $F=0$ and the spring force is zero; when $H<H_f$, then $F<0$ and the force is negative or compressive; and when $H>H_f$, then $F>0$ and the force is positive or tensile.

When the golf ball is at rest (no spin), a slight preload compressive force is applied to the moveable weight. This preload force prevents any undesirable free rattle of the moveable weight. The preload force is applied by selecting the combined length of the spring and the moveable weight to be greater than the depth of the channel in which they will be installed. See FIG. 22. FIG. 22 shows a preload force acting on the moveable weight in resting position, and D is the moveable weight diameter (or length); $H_f$ is the free height of the spring (unloaded); $R_o$ is the distance from the center of the golf ball to the plugged outer end of the channel; $R_1$ is the distance from the center of the golf ball to the center of the moveable weight in the resting position; $H_1$ is the deformed height of the spring; and $X_1$ is the spring deflection relative to the spring's free height $H_f$ in the resting position.

When the spring is compressed such that all of its coils are touching each other with no space in between, this is called the spring's solid height. The solid height is the minimum height that the spring can be compressed and still recover without permanent deformation. See FIG. 23. FIG. 23 shows a spring force acting on the moveable weight at solid height, where D is the moveable weight diameter (or length); $H_f$ is the free height of the spring (unloaded); $R_o$ is the distance from the center of the golf ball to the plugged outer end of the channel; $R_2$ is the distance from the center of the golf ball to the center of the moveable weight in the solid height position; $H_2$ is the deformed height of the spring at solid height; $H_s$ is the deformed height of the spring at solid height ($H_2=H_s$); and $X_2$ is the spring deflection relative to the spring's free height $H_f$ in the solid height position.

For any position R that the moveable weight may occupy between the resting position, $R_1$, and the solid height, $R_2$, the spring force can be determined as follows. See FIG. 24. FIG. 24 shows a spring force acting on the moveable weight at a general position, where D is the moveable weight diameter (or length); $H_f$ is the free height of the spring (unloaded); $R_o$ is the distance from the center of the golf ball to the plugged outer end of the channel; R is the distance from the center of the golf ball to the center of the moveable weight in any position between $R_1$ and $R_2$; H is the deformed height of the spring between $H_1$ and $H_2$; and X is the spring deflection relative to the spring's free height $H_f$ in the solid height position. From FIG. 24, $$H=R_o-R-D/2 \tag{4}$$

Substituting equation (4) into equation (3) yields (5) below.

$$X=R_o-R-D/2-H_f \tag{5}$$

Since $F=K\cdot X$, substitution of (5) yields (6) below.

$$F=K\cdot[R_o-R-D/2-H_f] \tag{6}$$

When the golf ball is at rest (no spin), a slight preload compressive force is applied to the moveable weight. This preload force $F_1$ can be determined by using the same methodology used in deriving equations 3 through 6 for the general case. See FIG. 22. Therefore, $$X_1=H_1-H_f \tag{7}$$

Based on FIG. 22, $$H=R_o-R_1-D/2 \tag{8}$$

Substituting (8) into equation (7) yields (9) below.

$$X_1=R_o-R_1-D/2-H_f \tag{9}$$

Again, since $F_1=K\cdot X_1$, then $$F_1=K\cdot[R_o-R_1-D/2-H_f] \tag{10}$$

When the spring is compressed such that all of its coils are touching each other with no space in between, this is called the spring's solid height. The solid height force $F_2$ can be determined by using the same methodology used in deriving equations 3 through 6 for the general case, discussed above. See FIG. 23.

$$X_2=H_2-H_f \tag{11}$$

and, based on FIG. 23, $$H_2=R_o-R_2-D/2 \tag{12}$$

Then, substituting (12) into (11) above yields (13), below.

$$X_2=R_o-R_2-D/2-H_f \tag{13}$$

Once again, since $F_2=K\cdot X_2$, then $$F_2=K\cdot[R_o-R_2-D/2-H_f] \quad (14)$$

Since the solid height of a spring is a dependent only upon the spring wire diameter, the number of coils in the spring and the end conditions (i.e. ground flat), this is a physical dimension of the spring. The solid height of the spring is often specified by the spring manufacturer.

$$H_2=H_s \quad (15)$$

Then, substituting (15) and (11) into (14) above yields (16), below.

$$F_2=K\cdot[H_s-H_f] \quad (16)$$

When the golf ball is spinning in the plane that includes the moveable weights, there are two forces acting on the moveable weight. The forces are the spring force and the centrifugal force generated by the spin. The frictional forces between the moveable weight and the channel walls and the force of gravity are small compared to the spring force and the centrifugal force. The transient vibrations that result from the impact of the golf club and ball are also ignored. Equilibrium is defined here as a steady state condition when the two primary forces are equal.

Since the forces acting on the moveable weight must be in equilibrium at all times, the compressive spring force must be equal to the centrifugal force at all times. See FIG. 25, which shows the forces acting on the moveable weight. From this condition of equilibrium, the position of the moveable weight can be determined for any given spin rate or the spin rate can be determined that corresponds to any given position. For equilibrium, $$Fc=Fs \quad (17)$$

For any position, R, that the moveable weight may occupy between the resting position, $R_1$ and the solid height, $R_2$, the condition of equilibrium can be applied. The spring force for this general condition was determined in (6), discussed above. The centrifugal force can be found as follows:

$$Fc=m\ a \quad (18)$$

and $$a=R\ \omega^2 \quad (19)$$

Substituting (19) into (18) yields (20), below.

$$Fc=m\ R\ \omega^2 \quad (20)$$

In the above equations, Fs spring force when the moveable weight is at position R; Fc is the centrifugal force when the core is spinning at ω and the moveable weight is at position R; R is the distance from the center of the golf ball to the center of the moveable weight in any position between $R_1$ & $R_2$; $R_1$ is the distance from the center of the golf ball to the center of the moveable weight in the resting position; $R_2$ is the distance from the center of the golf ball to the center of the moveable weight in the solid height position; $H_f$ is the free height of the spring (unloaded); $R_o$ is the distance from the center of the golf ball to the plugged outer end of the channel; D is the moveable weight diameter (or length);

a is the centrifugal acceleration of the moveable weight due to the spin rate ω;

m is the mass of moveable weight; and ω is the spin rate of core.

Substituting (20) and (6) into (17) above yields (21), below.

$$m\ R\omega^2=K\cdot[R_o-R-D/2-H_f] \quad (21)$$

Then, solving for ω in (21), yields (22) below.

$$\omega=(K\cdot(R_o-R-D/2-H_f)/m\ R)^{1/2} \quad (22)$$

Equation (22) can be utilized to find the spin rate that causes the moveable weight to overcome the spring preload force and begin to travel in a radial direction, outward from the center of the core. Substituting $R_1$ into (22) reveals the spin rate $\omega_1$ at which the moveable weights start to move from position $R_1$ as shown in (23) below:

$$\omega_1=(K\cdot(R_o-R_1-D/2-H_f)/m\ R_1)^{1/2} \quad (23)$$

Note that when $\omega\leqq\omega_1$, the moveable weight is pressed against the end of the channel by the preload force because the centrifugal force is less than the spring preload force. Equation (22) can also be utilized to find the spin rate that causes the moveable weight to compress the spring to its solid height. Substituting $R_2$ into (22) reveals the spin rate $\omega_2$ at which the moveable has moved to position $R_2$ as shown below in (24).

$$\omega_2=(K\cdot(R_o-R_2-D/2-H_f)/m\ R_2)^{1/2} \quad (24)$$

Note that when $\omega\geqq\omega_2$, the moveable weight can travel no further outward because the centrifugal force has compressed the spring to its minimum height. The centrifugal force is greater than the spring force at solid height. For spin rates greater than $\omega_1$ (the spin rate required to overcome the spring preload force) but less than $\omega_2$ (the spin rate required to compress the spring to its solid height) the moveable weight will be located between $R_1$ and $R_2$ Its exact position is determined by the spin rate. For $\omega_1<\omega<\omega_2$, the position of the moveable weight can be found by solving for R in equation (22), as shown below in (25).

$$R=K\cdot(R_o-D/2-H_f0)/(m\ \omega^2+K) \quad (25)$$

The mass moment of inertia can be determined for any position of the moveable weight. Assume that the mass moment of inertia of the completed ball or core with the moveable weights in the resting position $R_1$ is measured to be $I_1$. The mass moment of inertia of the ball can be determined for N moveable weights at any position R. Since the mass moment of inertia of the moveable weight about its center of mass does not change when it moves from position $R_1$ to any position R, the only change in mass moment of inertia comes from the motion of its center of mass.

For $R_1<R<R_2$, $$I=I_1+N\ m(R^2-R_1^2) \quad (26)$$

where N is the number of moveable weights; m is the mass of moveable weight; $I_1$ is the mass moment of inertia of the completed ball or core when the moveable weights in the resting position $R_1$; and I is the mass moment of inertia of the completed ball or core when the moveable weights in any position R such that $R_1<R<R_2$.

Equation (26) shows the minimum mass moment of inertia to be $I_1$, which occurs when the ball is at rest and the moveable weights are located at $R_1$. This also occurs whenever $\omega\leqq\omega_1$. Further examination of equation (26) reveals that the maximum mass moment of inertia is $I_2$, which occurs when the moveable weights are located at $R_2$. This also occurs whenever $\omega\geqq\omega_2$. While equation (26) is an expression of mass moment of inertia as a function of the position of the moveable weights, substituting (25) into (26) provides an expression for finding mass moment of inertia as a function of spin rate ω, as shown by (27) below.

$$I=I_1+N\ m((K\cdot(R_o-D/2-H_f)/(m\ \omega^2+K))^2-R_1^2) \quad (27)$$

The following figures illustrate the preferred embodiment golf balls of the present invention.

FIG. 1A illustrates a preferred embodiment golf ball 10 having a cover 12 disposed about a core 14. The core 14 defines five hollow channels 16*a*, 16*b*, 16*c*, 16*d*, 16*e*. A movable weight 17 and spring 18 are located within each hollow channel 16*a*, 16*b*, 16*c*, 16*d*, 16*e*. A plug 19 encloses the end of each hollow channel 16*a*, 16*b*, 16*c*, 16*d*, 16*e* at the outer edge or surface of the core 14. The spring 18 is located between the movable weight 17 and plug 19 and is in continuous contact with the moving weight 17. The term "continuous contact" refers to a configuration between spring and weight in which the spring 18 is always in contact, or substantially so, with the weight 17 regardless of the location of the weight 17 within its respective channel. Preferably, this is achieved by preloading the spring during assembly so that slight compression is on the spring and weight.

Figure 1B:
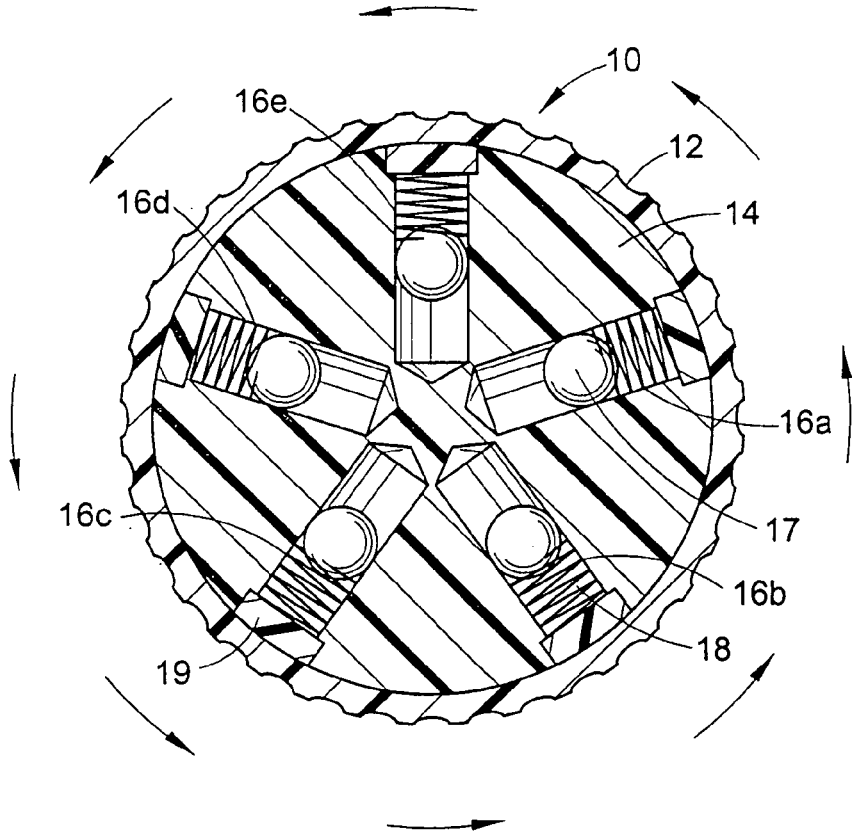
FIG. 1B depicts the same cross-sectional view of a golf ball as FIG. 1A, but the golf ball is spinning so that the movable weights are positioned outwardly and the springs are compressed.

FIG. 1B illustrates the golf ball 10 of FIG. 1A during rotational movement where the golf ball 10 has achieved a sufficient spin rate so that the movable weights 17 are displaced outwardly toward the outer periphery of the ball, thereby compressing the springs 18. In such circumstances, the centrifugal force produced by the movable weights is greater than the spring constant or force of the spring.

Figure 2A:
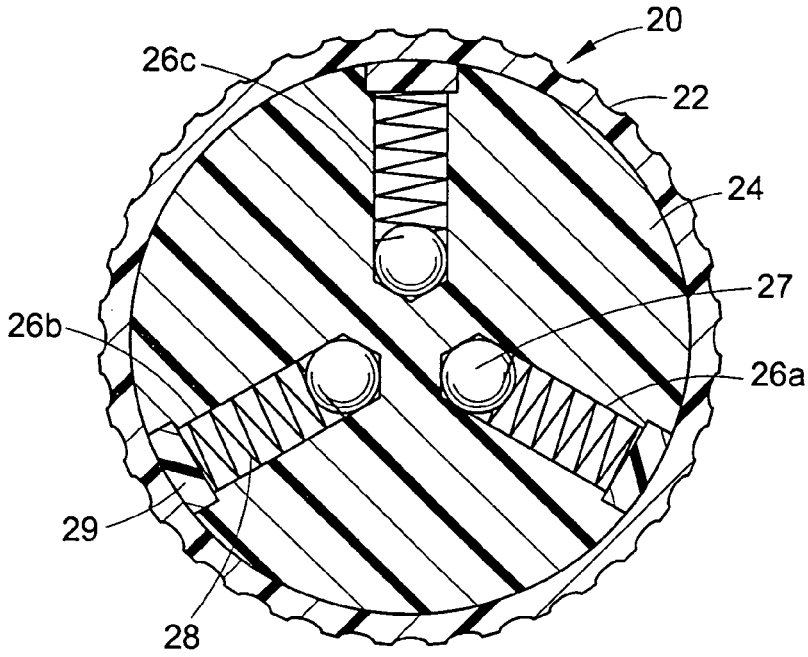
FIG. 2A depicts a cross sectional-view of a golf ball including a core defining three hollow channels, a movable weight and a compression spring within each hollow channel, a plug enclosing the end of each hollow channel at the outer edge of the core, and a cover disposed about the core.

FIG. 2A illustrates another preferred embodiment golf ball 20 having a cover 22 disposed about a core 24. The core 24 defines three hollow channels 26*a*, 26*b*, 26*c*. A movable weight 27 and spring 28 are located in each hollow channel 26*a*, 26*b*, 26*c*. A plug 29 encloses the end of each hollow channel 26*a*, 26*b*, 26*c* at the outer edge of the core 24. The spring 28 is located between the movable weight 27 and plug 29 and is in continuous contact with the movable weight 27.

Figure 2B:
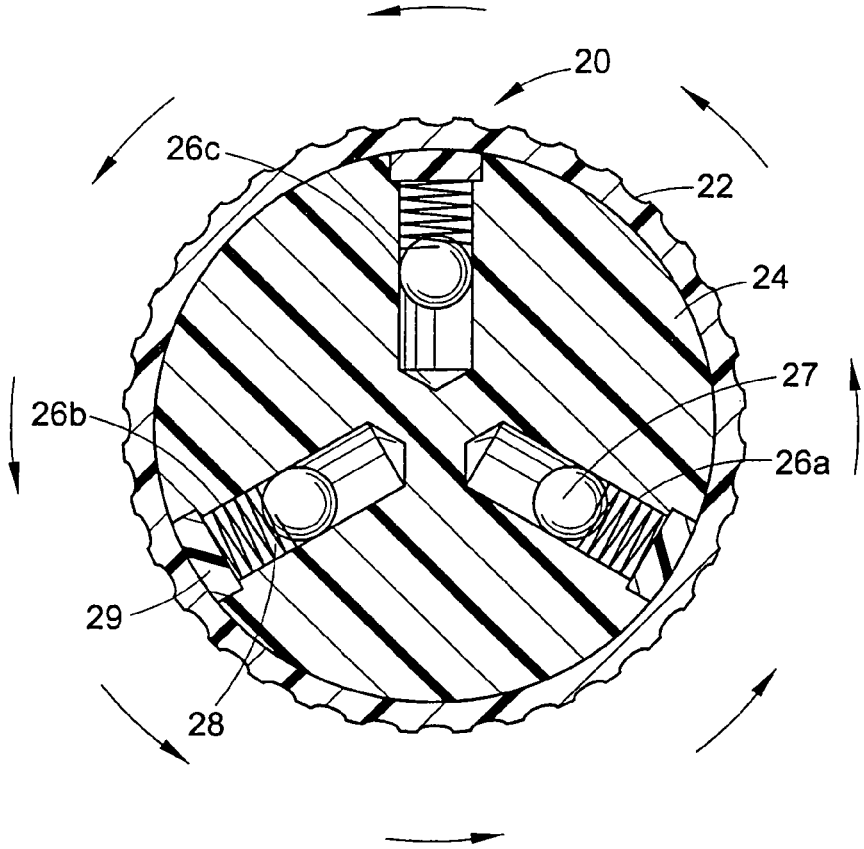
FIG. 2B depicts the same cross-sectional view of a golf ball as FIG. 2A, but the golf ball is spinning so that the movable weights are extended outwardly and the springs are compressed.

FIG. 2B illustrates the golf ball 20 of FIG. 2A during movement where the golf ball 20 has achieved a sufficient spin rate so that the movable weights 27 are displaced outwardly, thereby compressing the springs 28.

Figure 3:
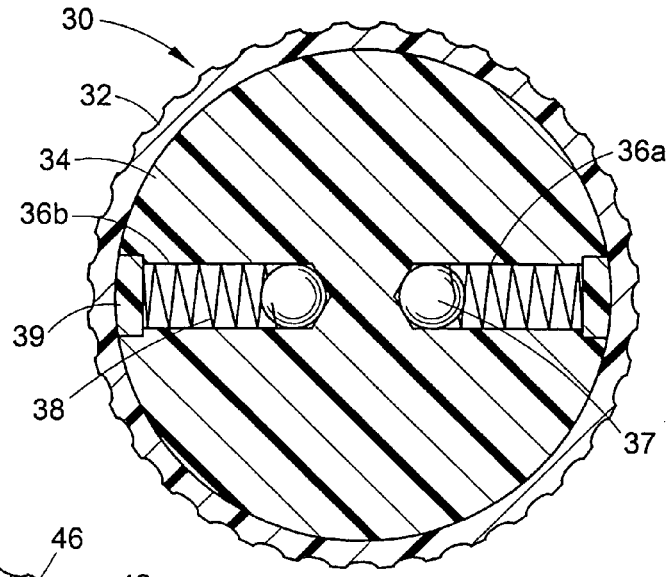
FIG. 3 depicts a cross-sectional view of a golf ball including a core defining two hollow channels, a movable weight and a compression spring within each hollow channel, a plug enclosing the end of each hollow channel at the outer edge of the core, and a cover disposed about the core.

FIG. 3 illustrates a further preferred embodiment golf ball 30 having a cover 32 disposed about a core 34. The core 34 defines two hollow channels 36*a*, 36*b*. A movable weight 37 and spring 38 are located in each hollow channel 36*a*, 36*b*. A plug 39 encloses the end of each hollow channel 36*a*, 36*b* at the outer edge of the core 34. The spring 38 is located between the movable weight 37 and plug 39 and is in continuous contact with the moving weight 37.

Figure 4:
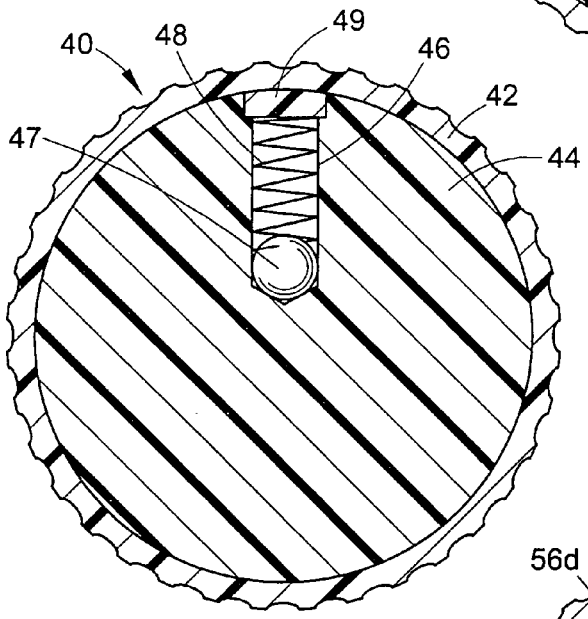
FIG. 4 depicts a cross-sectional view of a golf ball including a core defining one hollow channel, a movable weight and a compression spring within the hollow channel, a plug enclosing the end of the hollow channel at the outer edge of the core, and a cover disposed about the core.

FIG. 4 illustrates yet another preferred embodiment golf ball 40 having a cover 42 disposed about a core 44. The core 44 defines a hollow channel 46. A movable weight 47 and spring 48 are located in the hollow channel 46. A plug 49 encloses the end of the hollow channel 46 at the outer edge of the core 44. The spring 48 is located between the movable weight 47 and plug 49.

Figure 5:
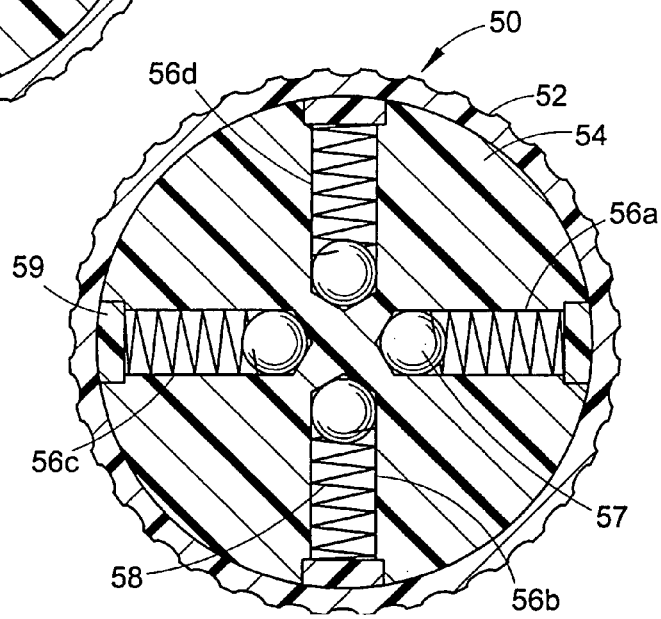
FIG. 5 depicts a cross-sectional view of a golf ball including a core defining four hollow channels, a movable weight and a compression spring within each hollow channel, a plug enclosing the end of each hollow channel at the outer edge of the core, and a cover disposed about the core.

FIG. 5 illustrates another preferred embodiment golf ball 50 having a cover 52 disposed about a core 54. The core 54 defines four hollow channels 56*a*, 56*b*, 56*c*, 56*d*. A movable weight 57 and spring 58 are located in each hollow channel 56*a*, 56*b*, 56*c*, 56*d*. A plug 59 encloses the end of each hollow channel 56*a*, 56*b*, 56*c*, 56*d* at the outer edge of the core 54. The spring 58 is located between the movable weight 57 and plug 59.

Before turning attention to additional features and aspects of the preferred embodiment golf balls, it is instructive to consider the physics of imparting spin to a golf ball. First, it is a basic fact that once a golf ball is struck, there is nothing more that a golfer can do to affect the flight of the ball. For almost all golf shots, the time between a club face first striking the ball to the point at which the ball springs completely clear of the club face and into flight is about one-half of a millisecond.

As most golfers are well aware, the spin that is imparted to a golf ball affects its flight, i.e. its trajectory. And so, by controlling the spin of a ball, a golfer can control, to a limited extent, certain aspects of the ball's flight.

Upon hitting a ball, it is rare that the ball exhibits pure backspin (rotation about a horizontal axis while in flight) or pure sidespin (rotation about a vertical axis while in flight). Instead, the actual spin of a ball during flight is a combination of these spin characteristics. As a result, during flight a golf ball will typically spin about a tilted axis or an axis that is oriented at some angle. These characteristics of spin are considered in greater detail below.

The core used in the preferred embodiment golf balls defines one or more hollow channels. Although one hollow channel may be used in the core, more than one hollow channel is desired for better balance and better overall durability. Generally, it is preferred that each channel extend radially outward from the center of the core toward the outer periphery of the core. It is also preferred that each channel extend straight and not contain any bends or arcuate portions. However, it is contemplated that the present invention golf ball could encompass a core configuration using non-linear interior hollow channels within which are disposed appropriate movable weights and springs as described herein. Also, when a plurality of hollow channels are defined by the core, the ends of the hollow channel near the center of the core are preferably not in communication with another hollow channel. As a result, it is preferred that each hollow channel is separate from the others. However, the present invention includes the use of a core having radially and oppositely directed channels that are in communication with each other.

It is also preferred that each of the hollow channels extend within the same plane and that the channels be equally spaced from one another. This same or common plane aspect is described in greater detail below. Equidistant spacing between adjacent channels extending in a common plane is determined by dividing 360° by the number of channels. For instance, if three channels are used, it is most preferred that each channel be spaced from the others by 120°. If five channels are used, it is most preferred that each channel be spaced from the others by 72°.

When a core defines a plurality of hollow channels, the hollow channels preferably extend along a common plane. That is, although the channels extend radially outward from the center of the core, the channels preferably all extend within a common plane. This unique configuration imparts to the ball a stabilizing gyroscopic characteristic. This characteristic is described in greater detail below. When the plurality of hollow channels are defined and extend along a single plane, as shown in FIGS. 1A–3, 4, and 5, a gyroscopic characteristic is exhibited when the golf ball attains a sufficient minimal spin rate so that the movable weights are displaced outwardly toward the outer periphery of the core. Particularly, the gyroscopic characteristic resulting from the outward movement of the weights and thus increase in the moment of rotational inertia of the ball, causes the axis of rotation of the ball to change until it is perpendicular, or approximately so, to the plane within which the hollow channels extend. That is, regardless of the initial orientation of the ball prior to striking with a club, once a sufficient spin rate is achieved so that the weights are outwardly displaced, the axis of rotation of the ball will change until that axis is perpendicular to the plane within which the hollow channels extend. This gyroscopic characteristic is beneficial in that it generally stabilizes the spinning ball and greatly reduces the tendency for the ball to hook or slice.

Figure 20:
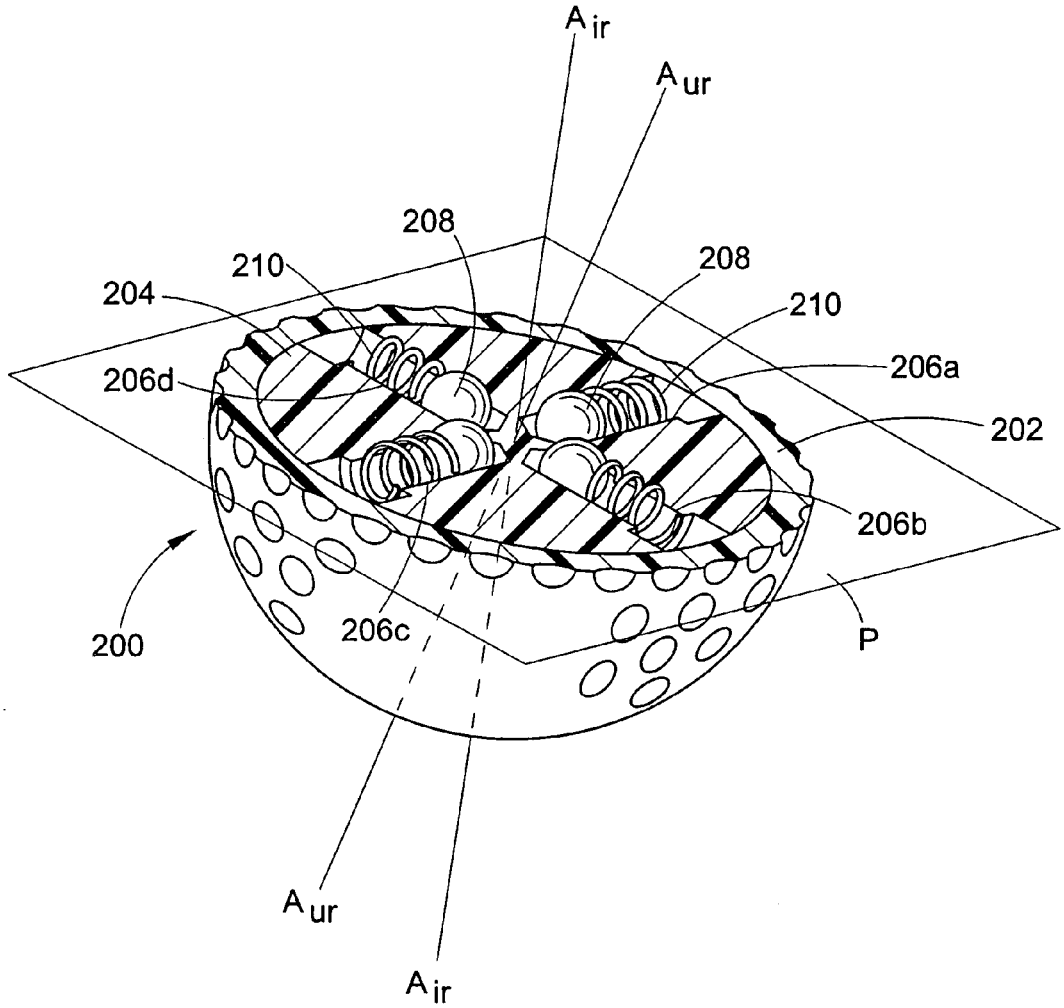
FIG. 20 is a partial cross-sectional illustration of a preferred embodiment golf ball denoting particular geometric aspects and characteristics of the ball and its components.

The unique geometric aspects of the preferred embodiment golf balls may be further understood by reference to FIG. 20. That figure illustrates a partial cross sectional view of a preferred embodiment golf ball 200 comprising a core 204 having a dimpled cover 202 disposed thereon. Defined within the core 204 are a plurality of radially extending hollow channels 206*a*, 206*b*, 206*c*, and 206*d*. Disposed within each channel are a movable weight 208 and spring 210 as described herein. It will be noted that all channels 206*a*, 206*b*, 206*c*, and 206*d* generally extend within a common plane P. The gyroscopic characteristic of the preferred embodiment golf balls of the invention is such that if the ball is struck and initially spinning about axis $A_{ir}$, i.e. the axis of initial rotation, the orientation of the channels, weights, and springs within the core of the ball will cause the ball to change its axis of spin to axis $A_{ur}$, i.e. the axis of ultimate rotation. As shown in FIG. 20, the axis $A_{ur}$ is perpendicular to plane P.

Regardless of how the ball is placed on the tee, the ball will seek and find the same horizontal axis each time after leaving the club face. The extended weights rotate around the horizontal spin axis perpendicular to the flight path.

It may be beneficial to know the location of the internal weights and channels within the golf ball. If the weights are as shown in FIG. 20 and plane P is the equator, it is better to hit the ball with either woods or irons oh the poles rather than on the equator (or plane P) to avoid impacting the plug area. For putting the ball, it is better to orient the ball having plane P vertical, and the ball will roll with the spinning axis A horizontal to the putting surface. This may stabilize the putt and keep it on line.

In order to facilitate properly orienting the ball on a putting green or a tee, the preferred embodiment golf balls of the present invention may also include markings or other visible indicia on the outer cover of the ball to denote the orientation of the channels within the core, i.e. the orientation of plane P. Alternatively or in addition, the preferred embodiment golf balls may include a marking to reveal the orientation of axis $A_{ur}$.

Although the preferred embodiment golf balls of the present invention preferably utilize a plurality of channels that generally extend within a common, single plane, the present invention also encompasses embodiments in which one or more channels extend in two or more planes. For instance, a core configuration having six (6) channels is contemplated in which each channel is equidistant from adjacent channels and generally perpendicular to adjacent channels. A golf ball utilizing this embodiment would generally not favor a particular orientation or axis of rotation during spinning. This may be desirable for certain applications.

The cross sectional shape of the hollow channel defined within the core may vary. Preferably, the hollow channel is generally cylindrical. Alternatively, the hollow channel may be in the form of nearly any shape, such as rectangular, pentangular, etc. It is preferred that all channels utilized in a core have the same cross sectional shape.

The hollow channel may also have any length within the core. Preferably, the hollow channel extends between the outer edge or periphery of the core to near the center of the core, as shown in FIGS. 1–5. When more than one hollow channel is used, it is most preferred that the center of the core is not hollow and thereby serves as a barrier between the channels and the hollow channels, thus preventing communication between the channels.

Figure 6A:
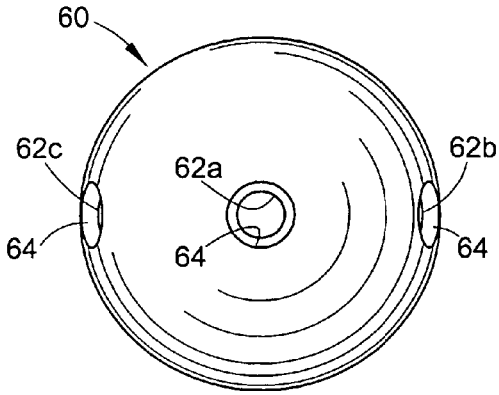
FIG. 6A depicts a frontal view of a core having five hollow channels showing the ends of three hollow channels at the outer edge of the core.
Figure 6B:
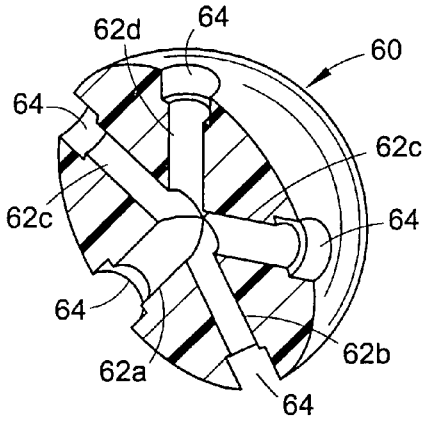
FIG. 6B depicts an isolated transparent angular view of the core in FIG. 6A having the five hollow channels and shoulders at the end of the hollow channels.

The end of the hollow channel at the outer edge of the core can have a width or span equal to, less than, or greater than the width or span of the hollow channel at any location between the ends. FIGS. 6A and 6B illustrate a core 60 having five hollow channels 62*a*, 62*b*, 62*c*, 62*d*, 62*e* (62*d* and 62*e* are viewed from behind and are not shown on FIG. 6A). The outer edge of the core 60 defining the end of the hollow channel 62*a*, 62*b*, 62*c*, 62*d*, 62*e* defines a shoulder 64 that has a width greater than the width of the hollow channel 62*a*, 62*b*, 62*c*, 62*d*, 62*e* between the ends of the hollow channel 62*a*, 62*b*, 62*c*, 62*d*, 62*e*. The shoulder 64 is useful to provide structural support for a plug.

Figure 7:
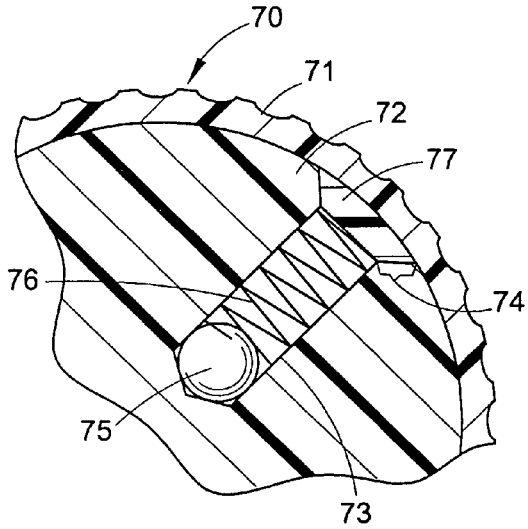
FIG. 7 depicts a partial cross-sectional view of a golf ball including a core defining a hollow channel, an angled shoulder at the end of the hollow channel adjacent the outer edge of the core, a movable weight and a compression spring located in the hollow channel, a plug enclosing the end of the hollow channel, and a cover disposed about the core.
Figure 8:
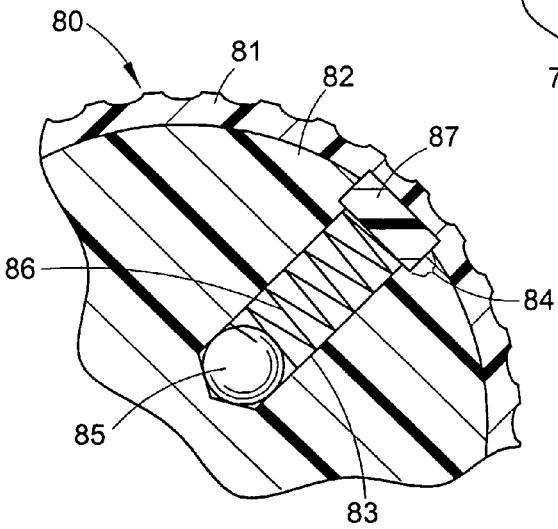
FIG. 8 depicts a partial cross-sectional view of a golf ball having a core defining a hollow channel, a shoulder at the end of the hollow channel adjacent the outer edge of the core, a movable weight and a compression spring located in the hollow channel, a plug enclosing the end of the hollow channel, and a cover disposed about the core.

The shoulder can have a variety of shapes. The shoulder preferably has a circular cross sectional configuration with either cylindrical or conical sidewalls extending between the channel and the outer surface of the core. FIG. 7 illustrates a portion of a golf ball 70 having a cover 71 disposed about a core 72. The core 72 defines a hollow channel 73. A conical shaped shoulder 74 extends between the channel 73 and outer surface of the core 72. A movable weight 75 and spring 76 are located in the hollow channel 73. A plug 77 is located in the shoulder 74 and encloses the end of the hollow channel 73. FIG. 8 shows a portion of a golf ball 80 having a cover 81 disposed about a core 82. The core 82 defines a hollow channel 83. A cylindrically shaped shoulder 84 extends between the channel 73 and the outer surface of the core 82. The end of the hollow channel 83 at the edge of the core 82 has a width or span greater than the width or span of the hollow channel 83. A movable weight 85 and spring 86 are located in the hollow channel 83. A plug 87 is located in the shoulder 84 and encloses the end of the hollow channel 83.

Although it is preferred that the width or interior span of the channel be generally uniform across the length of the channel, it is possible that the width may be non-uniform. For instance, the present invention includes embodiments in which the width or interior span of the ends of the channel vary. The width or span of the end of the hollow channel near the center of the core is generally equal to or less than the width or span of the hollow channel between the ends. However, it will be appreciated that the width or span of the end of the hollow channel near the center of the core can be greater than the width or span of the hollow channel between the ends. It is preferred that the end of the hollow channel near the center of the core have a width equal to or less than the width of the hollow channel between the ends.

The hollow channel preferably has a uniform width or span, as measured between the ends, of no greater than about 1.0 inches. Preferably, the hollow channel has a width between the ends of from about 0.10 inches to about 0.50 inches. Most preferably, the hollow channel has a width of about 0.25 inches. The width of the hollow channel may vary depending on the number of hollow channels within a core, the size of the movable weights, etc. Generally, the greater the number of hollow channels in the core, the smaller the width of each channel.

The hollow channel is preferably formed by drilling from the outer edge of the core inwardly to near the center of the core or through the core to a second outer edge. Typically, when a hollow channel is drilled or otherwise formed so that the end of the hollow channel is near the center of the core, that end has a width equal to or less than the width of the hollow channel between the ends. Also, a shoulder at the end of the hollow channel at the outer edge of the core can be formed during drilling by use of a countersink or counterbore drill bit. Alternatively, two core halves may be formed by molding such that each half contains recesses so that when the two halves are placed together, a core having one or more hollow channels and shoulders is formed. The channels may also be "molded in" using retractable non-stick coated pins (i.e., Teflon® coated) in the mold cavity. The pins are retracted after the core is cured, forming hollow channels inside the core.

At least one movable weight is located within the hollow channel. The movable weight is formed from a variety of metallic or non-metallic materials. The material used in forming the movable weight preferably has a mass approximately equivalent to the mass lost when the hollow channel is formed within the core in order to maintain the desired overall mass of the golf ball. The movable weight is preferably formed of a material and has a particular shape and size in order to minimize the friction between the movable weight and the interior walls of the hollow channel so that the weight may freely move through the channel as the golf ball undergoes various rates of spin. The movable weight is typically formed from a material having a relatively high specific gravity, although the specific gravity can vary depending on the desired change in moment of inertia upon displacement of the movable weights. Preferably, the weight is formed of a metallic material. Metallic materials which may be used as the weight include, but are not limited to brass, steel, iron, tungsten, copper and nickel, etc.

The movable weight may have any size or shape as long as the weight can be inserted into the hollow channel and can readily move along the length of the hollow channel, or that portion of length permitted by the springs or other components. Shapes for the movable weight include spherical, cylindrical, or any other geometric shape desired. Spherical shaped moving weights are shown in FIGS. 1–5. The width or diameter of the movable weight can vary. The width or diameter of the movable weight is less than the width or diameter of the hollow channel between the ends of the hollow channel so that the movable weight can move within the hollow channel. The movable weight has a diameter or width of less than 1.0 inch. More preferably, the movable weight has a width or diameter of between about 0.1 inches and 0.50 inches. Most preferably, the movable weight has a width or diameter of less than about 0.25 inches.

Figure 9:
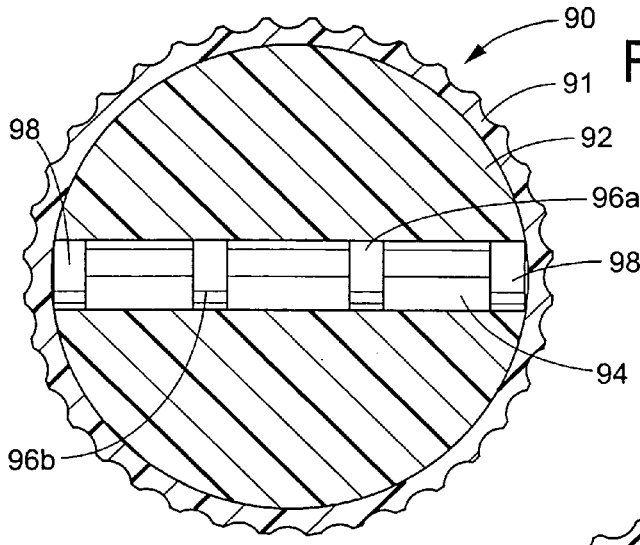
FIG. 9 depicts a cross sectional view of a golf ball including a core defining a hollow channel, two weights, each movable within the hollow channel, each weight comprising a magnet, two plugs, each comprising a magnet enclosing the ends of the hollow channel at the outer edge of the core, and a cover disposed about the core.

The movable weight may comprise a magnet. FIG. 9 illustrates a golf ball 90 including a cover 91 disposed about a core 92. The core 92 defines a hollow channel 94. The hollow channel 94 has one end defined at a first outer edge of the core 92 and a second end defined at an outer edge of the core different from the first outer edge. Disposed within the channel 94 are two movable weights 93 and 95. Each of the weights has corresponding oppositely directed faces. Thus, weight 93 has opposite faces 93*a* and 93*b*; and weight 95 has opposite faces 95*a* and 95*b*. Each of the weights has a magnet oriented such that the poles of the magnet are oriented along the longitudinal axis of the channel 94. Positioned at each end of the channel 94 are two plugs 98. Each of the plugs has a face 98*a* directed to a movable weight 93 or 95. Similarly, each of the magnets associated with the plugs are oriented such that the poles of the magnet are oriented along the longitudinal axis of the channel. More specifically, the magnets of the plugs 98 and the movable weights 93 and 95 are oriented such that the same magnetic pole of each pair of magnets face each other. For example, the pole of the magnet associated with movable weight 93 and which is exposed to or nearest face 93*a*, is the same as the pole of the plug magnet nearest weight 93 and which is exposed to or nearest face 98*a*. Similarly, the pole of the magnet associated with movable weight 95 and which is exposed to or nearest face 95*a*, is the same as the pole of the plug magnet nearest weight 95 and which is exposed to or nearest face 98*a*. As a consequence of the foregoing noted orientation, the pole of the magnet associated with weight 93 and which is exposed to or nearest face 93*b* is the same as the pole of the magnet associated with weight 95 and which is exposed to or nearest face 95*b*.

Figure 10:
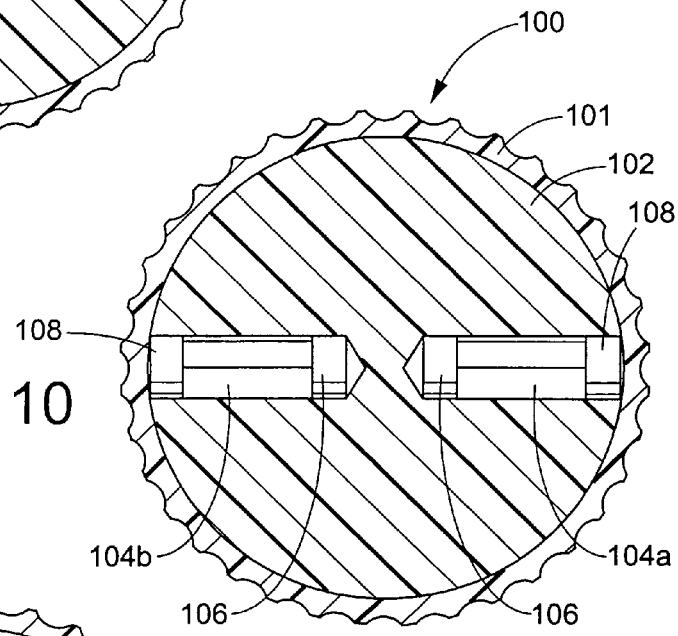
FIG. 10 depicts a cross sectional view of a golf ball including a core defining two hollow channels, a movable weight comprising a magnet in each hollow channel, and a plug comprising a magnet enclosing the end of the hollow channels at the outer edge of the core. A cover is disposed about the core.

FIG. 10 shows a golf ball 100 including a cover 101 disposed about a core 102 defining two hollow channels 104*a*, 104*b*. A movable weight 106 comprising a magnet is located in each hollow channel 104*a*, 104*b*. A plug 108 comprising a magnet is inserted into the end of the hollow channel 104*a*, 104*b* at the outer edge of the core 102. As previously described, the portion of the movable weight 106 facing the plug 108 has the same magnetic charge as the portion of the plug 108 facing the movable weight 106.

Figure 11:
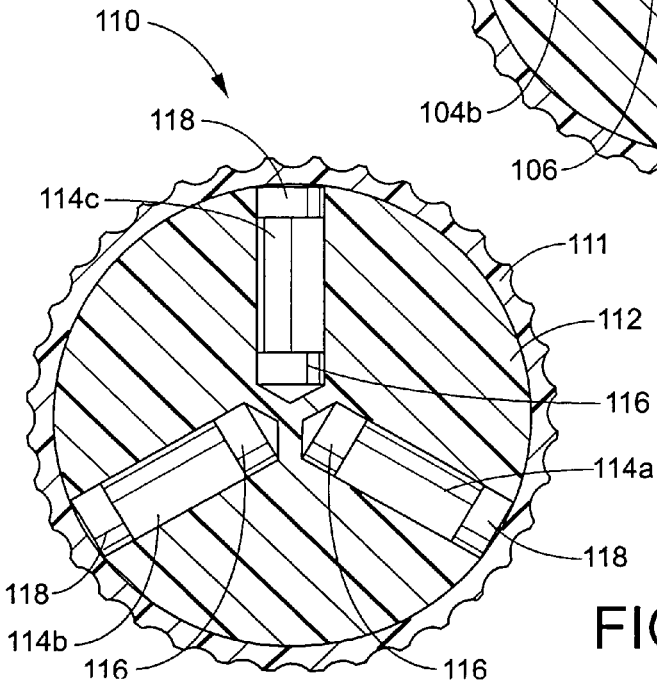
FIG. 11 depicts a cross sectional view of a golf ball including a core defining three hollow channels, a movable weight comprising a magnet in each hollow channel, a plug comprising a magnet enclosing the end of the hollow channels at the outer edge of the core, and a cover disposed about the core.

FIG. 11 illustrates a golf ball 110 including a cover 111 disposed about a core 112 having three hollow channels 114*a*, 114*b*, 114*c*. A movable weight 116 comprising a magnet is located in each hollow channel 114*a*, 114*b*, 114*c*. A plug 118 is inserted into the end of the hollow channel 114*a*, 114*b*, 114*c* at the outer edge of the core 112. As previously described, the portion of the movable weight 116 facing the plug 118 has the same magnetic charge as the portion of the plug 118 facing the movable weight 116.

When the golf balls 90, 100 and 110, are at rest, the magnetic movable weight and corresponding plug repel one another due to their same magnetic polarity, thereby controlling the movement or position of the movable weights. When the ball is struck and achieves a sufficient minimal spin rate, the resulting centrifugal force moves the magnetic movable weights outwardly towards the corresponding plug until the weight either comes into contact with the magnetic plug or the force of the repulsion between the magnetic weight and magnetic plug is greater than the centrifugal force. As the spin rate of the golf ball decreases, the repulsion force between the plug and weight is greater than the centrifugal force at that relatively slower spin rate so that the weight returns towards the center of the core.

Yet another embodiment involves using the magnetic force between two movable weights to attract the weights toward one another while the ball is at rest. Upon rotation of the ball, the centrifugal force urges each of the two movable weights radially outward. Preferably, such embodiment would utilize the ball structure illustrated in FIG. 10. The strength of the magnets and the rate of rotation of the ball will determine the rate and degree of separation of the two weights. Advantages of this embodiment are that springs are not required, and that the movable weights may be displaced further radially outward as compared to if springs were used. The thickness of the core portion between the interior channels generally controls the magnetic attraction between the movable weights.

The golf balls in FIGS. 9, 10, and 11 may optionally include a spring or spring-like device in each hollow channel. The spring or spring-like device may be located between the moving weight and plug, or between the moving weight and the end of the hollow channel near the center of the core.

Although FIGS. 9, 10, and 11 show one, two and three hollow channels, respectively, it is apparent that a golf ball core according to the present invention may define any number of hollow channels. It is also apparent that the golf ball core may define one hollow channel from the outer edge of the core extending inwardly to approximately the center of the core and include at least one moving weight comprising a magnet. Also, the hollow channel or channels may include more than one moving weight comprising a magnet. When a core defines a plurality of hollow channels, the hollow channels may be formed on a single axis or radially on multiple axes.

As noted, the preferred embodiment golf balls of the present invention further include a spring or spring-like device disposed in each hollow channel. Depending on the orientation of the spring relative to the movable weight, the spring compresses or expands, i.e. tensions, as the movable weight extends outwardly once the golf ball achieves a particular spin rate. The end of the spring nearest the movable weight is in continuous contact with the weight. As shown in FIGS. 1–5, when the spring is located between the movable weight and plug within the hollow channel, the spring compresses as the golf ball spins due to the centrifugal force pushing the weight from near the center of the golf ball towards the outer periphery of the core. The spring or spring-like device expands as the spin rate decreases so that the weight returns to near the center. When the golf ball is at rest or has a low spin, the spring maintains force on the movable weight so that the weight maintains its position near the center of the ball. The spring ensures that the movable weight does not move when the golf ball is slightly moved or when the ball has not obtained a sufficient minimal spin rate.

The spring constant (also known as the spring rate or spring tension) of the spring or spring-like device can vary. A spring with a higher spring constant will require a greater spin rate, and thus, a greater centrifugal force for the movable weight to move outwardly as compared to a spring with a relatively lower spring constant. Likewise, a spring having a lower spring constant requires a relatively lower spin rate, and thus, a lower centrifugal force for the movable weight to move outwardly. Therefore, the spring constant or spring rate may be selected in order to adjust the minimal spin rate at which the movable weight extends radially outward toward the outer periphery of the golf ball.

Specifically, the spring constant is selected so that little or no movement of the springs and movable weights occur when the golf ball is undergoing minor movement, such as during putting. The spring constant may be increased, for example, to prevent the movement of the movable weight when struck with drivers and fairway woods, but yet allow the weights to move outwardly when struck with irons that produce a much higher spin rate than drivers and fairway woods. Golf balls of the present invention can be designed to allow the weights to move outwardly at desired minimal golf ball spin rates such as 1000 rpm, 3000 rpm, 5,000 rpm, 8000 rpm, etc.

Springs may be formed of any material which would allow the spring to compress and depress during changes in spin rate of the ball. Preferably, the springs are formed of a metallic material, such as steel. Also, the spring can be any type of spring known in the art. Preferably, the spring is a coil spring. Also, depending on the orientation of the spring relative to the movable weight within the hollow channel, a spring may be a tension spring, a compression spring or exhibit the properties of both a tension spring and compression spring.

Springs of various lengths, widths, loads, and weights may be used in order to allow the movable weights to move at lower or higher spin rates. Generally, springs having a lower stiffness (softer springs) allow the movable weights to move toward the outer edge of the core at a lower spin rate when struck with a golf club, thereby allowing a golf ball to exhibit an increased moment of inertia at a relatively low spin rate. Alternatively, springs having a higher stiffness (harder springs) allow the movable weights to move towards the outer edge of the core at a higher spin rate, thereby allowing the golf ball to exhibit an increased moment of inertia at a relatively higher spin rate.

Figure 12:
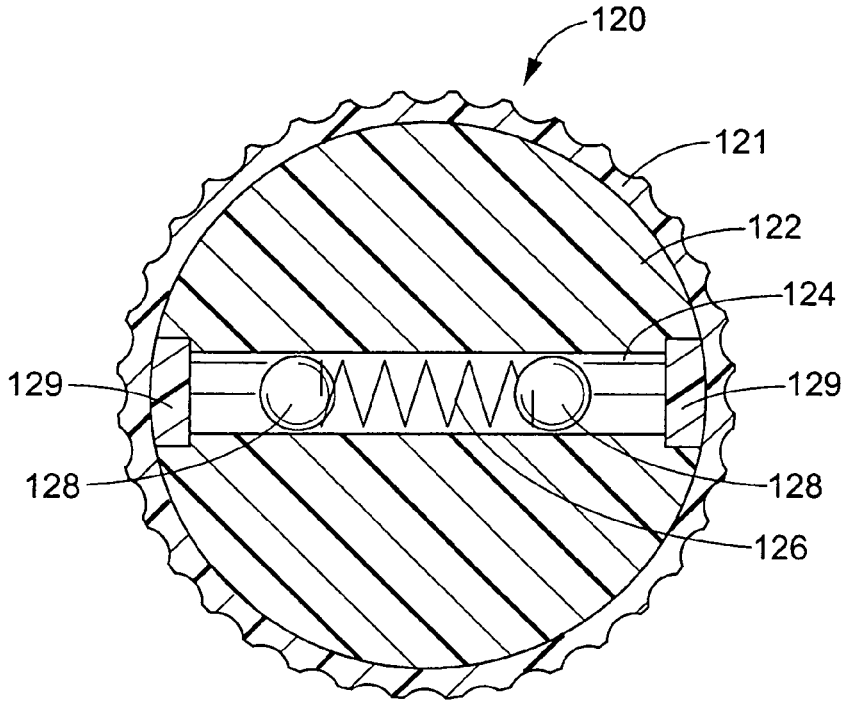
FIG. 12 depicts a cross sectional view of a golf ball including a core defining a hollow channel, an extension spring located in the hollow channel, a movable weight on each side of the spring within the hollow channel, a plug enclosing each end of the hollow channel at the outer edge of the core, and a cover disposed about the core.

The spring can be positioned near the center of the core so that the movable weight is between the spring and plug. FIG. 12 illustrates another embodiment of the present golf ball 120 having a cover 121 disposed about a core 122. The core 122 defines a hollow channel 124. The hollow channel 124 has a first end located at the outer edge of the core, extending through the core, and has the second end at the outer edge of the core different from the first end. An extension spring 126 is located within the hollow channel 124 at or near the center of the core 122. The spring 126 is maintained at the center of the core 122 by an attaching means (not shown) so that the spring 126 does not slide within the hollow channel 124. The attaching means may include any adhesive material known in the art that would allow the spring to maintain its position relative to the hollow channel. A movable weight 128 is located on each side of the spring 126. The movable weights 128 are preferably attached to the spring 126. A plug 129 encloses the ends of the hollow channel 124 at the end of the core 122. At rest, the movable weights 128 are tensioned by the spring 126 towards the center of the core 122. When the golf ball 120 attains a sufficient minimal spin so that the centrifugal force overcomes the force exerted by the spring 126 on the weights 128, the moving weights 128 move outwardly towards the outer surface of the core 122, thereby extending the spring 126 and increasing the moment of inertia of the ball 120. As the rotational velocity of the ball 120 decreases, the spring 126 compresses and pulls the weights 128 towards the center of the core 122, thereby decreasing the moment of inertia.

Figure 13:
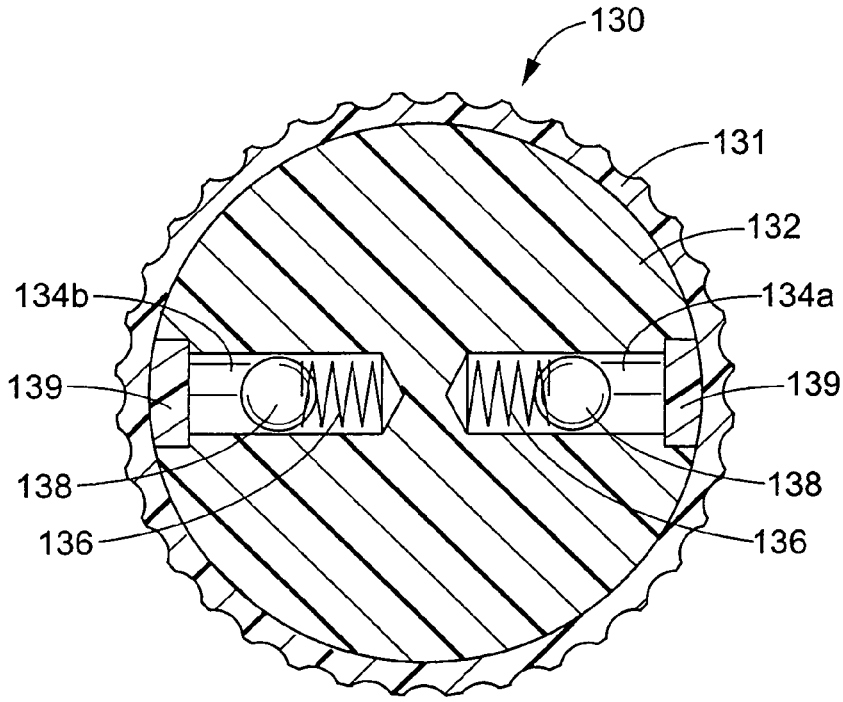
FIG. 13 depicts a cross-sectional view of a golf ball including a core defining two hollow channels, an extension spring within each hollow channel, a plug enclosing the ends of the hollow channels, a movable weight in each hollow channel between the spring and plug, and a cover disposed about the core.

FIG. 13 illustrates a golf ball 130 having a cover 131 disposed about a core 132. The core 132 defines two hollow channels 134*a*, 134*b*. A spring 136 is located in each hollow channel 134*a*, 134*b*. A weight 138 is disposed between the spring and the end of the hollow channel 134*a*, 134*b* at the outer edge of the core 132. The weight 138 is attached to the spring 136. The end of the hollow channel 134*a*, 134*b* at the outer edge of the core is enclosed by a plug 139.

Figure 14A:
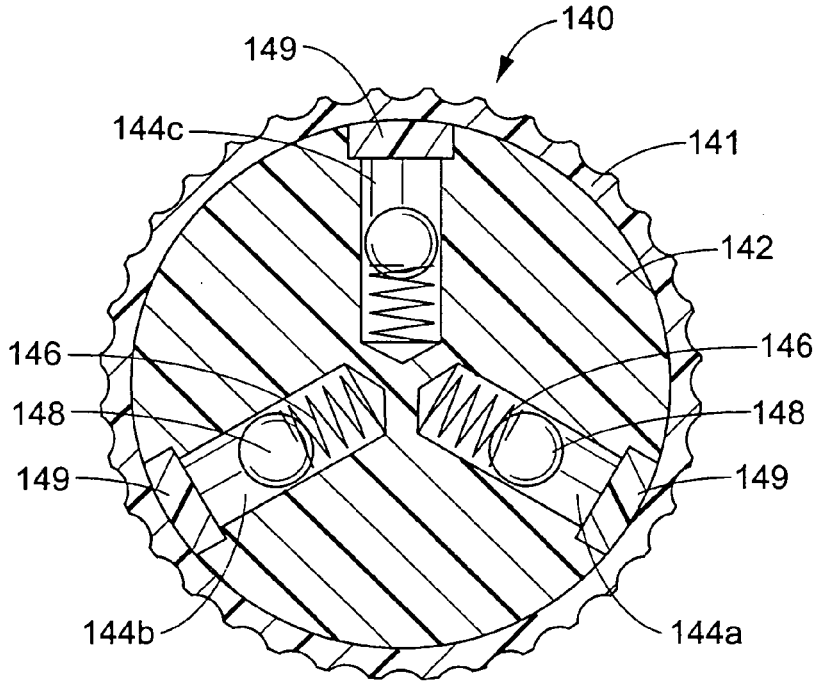
FIG. 14A depicts a cross-sectional view of a golf ball including a core defining three hollow channels, an extension spring within each hollow channel, a plug enclosing the ends of the hollow channels, a movable weight in each hollow channel between the spring and plug, and a cover disposed about the core.

FIG. 14A illustrates a golf ball 140 having a cover 141 disposed about a core 142. The core 142 defines three hollow channels 144*a*, 144*b*, 144*c*. A spring 146 is located in each hollow channel 144*a*, 144*b*, 144*c*. A movable weight 148 is disposed between the spring and the end of the hollow channel 144*a*, 144*b*, 144*c* at the outer edge of the core 142. The weight 148 is attached to the spring 146. The end of the hollow channel 144*a*, 144*b*, 144*c* at the outer edge of the core is enclosed by a plug 149.

Figure 14B:
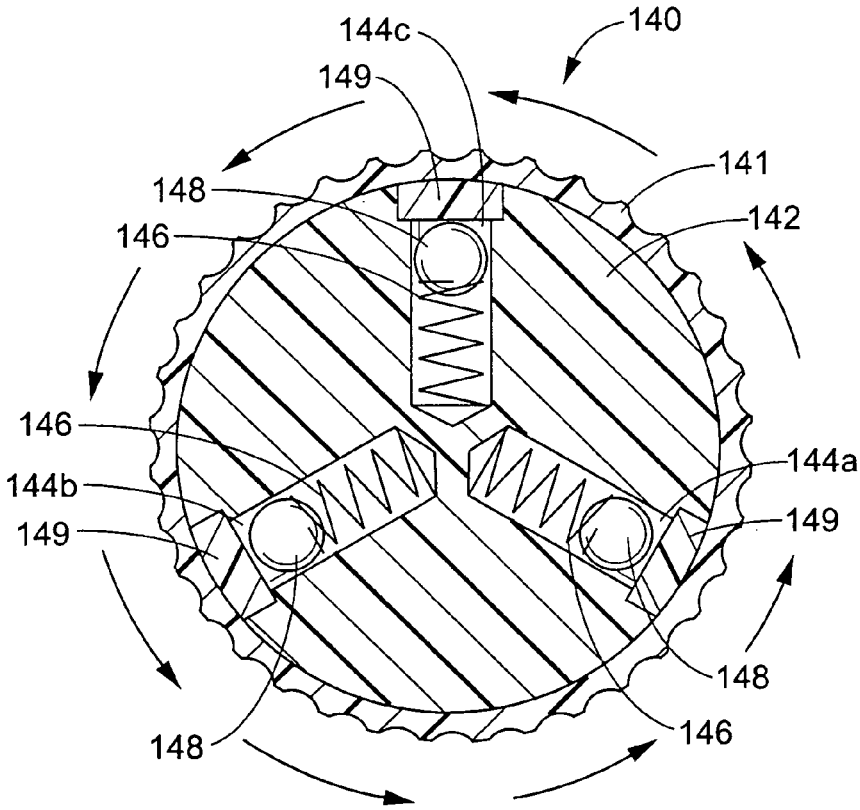
FIG. 14B depicts a cross-sectional view of a golf ball as in FIG. 14A, but the golf ball is spinning so that the movable weights are extended outwardly.

FIG. 14B further illustrates the golf ball 140 of FIG. 14A in rotation where the golf ball 140 has achieved a sufficient spin rate so that the weights 148 have been displaced outwardly towards the plugs 149, thereby extending the springs 146.

The spring may be connected to the movable weight. When the weight is positioned between a spring and a plug, as in FIGS. 12–14B, it is preferred that the spring and weight be connected. When the spring is positioned between a weight and plug, as in FIGS. 1–5, it may be preferred that the weight and spring not be connected.

Figure 15:
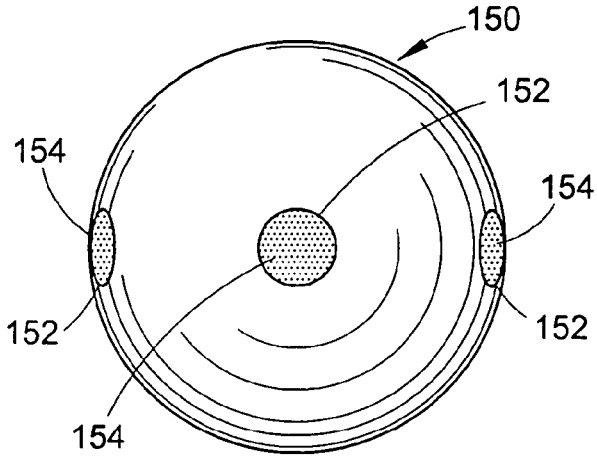
FIG. 15 depicts a frontal view of a core defining five hollow channels (two channels not shown) and a plug enclosing the end of each hollow channel.

A plug or disk preferably encloses the end or ends of a hollow channel at the outer edge of the core. A cover may also be molded over the hollow channel. FIG. 15 illustrates a golf ball core 150 with the ends of the hollow channels 152 having a spring and weight (not shown) enclosed by a plug 154. The plug or disk can be formed of any material used for golf ball cores, including core compositions having materials such as rubber and polybutadiene, as disclosed in U.S. Pat. Nos. 6,018,003; 5,998,506; and 5,984,806, incorporated herein by reference. Alternatively, the plug or disk may be formed of a cover or intermediate layer material known in the art. The plugs or disks are used in the preferred embodiment golf balls in order to prevent the cover stock from leaking into the hollow channels during injection or compression molding of the cover and also to counterbalance the weight lost due to the removal of the core materials during drilling or formation of the hollow channel.

Figure 16:
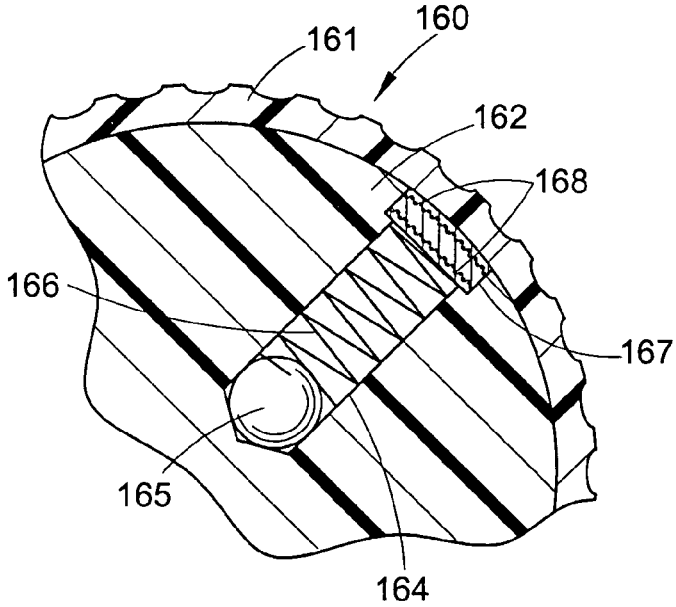
FIG. 16 depicts a partial cross-sectional view of a golf ball having a core defining a hollow channel, a shoulder at the end of the hollow channel along the outer edge of the core, a movable weight and a compression spring in the hollow channel, a plug including two wire mesh enclosing the end of the hollow channel, and a cover disposed about the core.

The plug or disk may further include at least one metallic mesh or screen. The metallic mesh or screen provides additional support to the plug. The mesh may be located near the edge of the plug or near the center of the plug. FIG. 16 illustrates a golf ball 160 having a cover 161 disposed about a core 162. The core 162 defines a hollow channel 164. A movable weight 165 and spring 166 is located in the hollow channel 164. A plug 167 encloses the end of the hollow channel 164 at the outer edge of the core 162. The plug 167 includes a wire mesh 168 near the edge of the plug 167 facing the hollow channel 164 and near the edge of the plug 167 facing the outer edge of the core 162.

Figure 17:
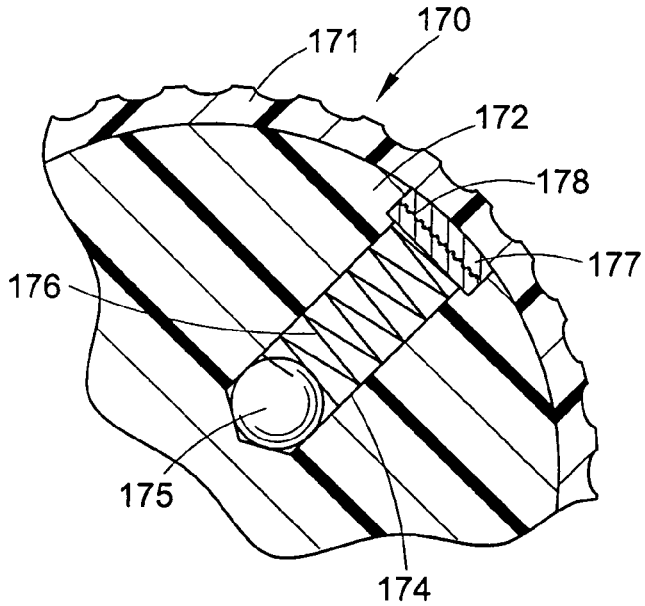
FIG. 17 depicts a partial cross-sectional view of a golf ball having a core defining a hollow channel, a movable weight and a compression spring located in the hollow channel, a plug including a wire mesh near the center of the plug located in the shoulder and enclosing the end of the hollow channel, and a cover disposed about the core.

FIG. 17 illustrates a portion of a golf ball 170 having a cover 171 disposed about a core 172. The core 172 defines a hollow channel 174. A movable weight 175 and spring 176 is located in the hollow channel 174. A plug 177 encloses the end of the hollow channel 174. The plug 177 includes a wire mesh 178 near the center of the plug 177.

The mesh may be included in the plug composition before curing so that the mesh is located within the plug once the plug cures, or may be included on one or more of the outer edges of the plug. The metallic mesh may be formed of any metallic material. Preferably, the metallic mesh is an aluminum mesh. The plug may be formed of other materials, such as metals, rubbers, elastomers, nylons, thermoplastics, and any other suitable material desired.

Preferably, the plugs or disks have a relatively high specific gravity in order to counterbalance the overall weight of the ball. The specific gravity of the plug may be increased by a filler. The preferred fillers for use with the plug are relatively inexpensive and heavy and serve to lower the cost of the ball and to increase the weight of the ball to closely approach the USGA® weight limit of 1.620 ounces. Exemplary fillers for use in the plug are those known in the golf ball manufacturing art, and they include mineral fillers such as zinc oxide, limestone, silica, mica, barytes, lithophone, zinc sulphide, talc, calcium carbonate, clays, powdered metals and alloys such as bismuth, brass, bronze, cobalt, copper, iron, nickel, tungsten, aluminum, tin, etc. Limestone is ground calcium/magnesium carbonate and is used because it is an inexpensive, heavy filler. Preferably, the specific gravity of the plug is at least 2.0. More preferably, the plug has a specific gravity of at least 2.2.

Examples of various suitable heavy filler materials which can be included in the present invention are as follows:

| Filler Type | Spec. Gravity |
|---|---|
| graphite fibers | 1.5–1.8 |
| precipitated hydrated silica | 2.0 |
| clay | 2.62 |
| talc | 2.85 |
| asbestos | 2.5 |

-continued

| Filler Type | Spec. Gravity |
|---|---|
| glass fibers | 2.55 |
| aramid fibers (Kevlar ®) | 1.44 |
| mica | 2.8 |
| calcium metasilicate | 2.9 |
| barium sulfate | 4.6 |
| zinc sulfide | 4.1 |
| silicates | 2.1 |
| diatomaceous earth | 2.3 |
| calcium carbonate | 2.71 |
| magnesium carbonate | 2.20 |
| Metals and Alloys (powders) | |
| titanium | 4.51 |
| tungsten | 19.35 |
| aluminum | 2.70 |
| bismuth | 9.78 |
| nickel | 8.90 |
| molybdenum | 10.2 |
| iron | 7.86 |
| copper | 8.94 |
| brass | 8.2–8.4 |
| boron | 2.364 |
| bronze | 8.70–8.74 |
| cobalt | 8.92 |
| beryllium | 1.84 |
| zinc | 7.14 |
| tin | 7.31 |
| Metal Oxides | |
| zinc oxide | 5.57 |
| iron oxide | 5.1 |
| aluminum oxide | 4.0 |
| titanium dioxide | 3.9–4.1 |
| magnesium oxide | 3.3–3.5 |
| zirconium oxide | 5.73 |
| Metal Stearates | |
| zinc stearate | 1.09 |
| calcium stearate | 1.03 |
| barium stearate | 1.23 |
| lithium stearate | 1.01 |
| magnesium stearate | 1.03 |
| Particulate Carbonaceous Materials | |
| graphite | 1.5–1.8 |
| carbon black | 1.8 |
| natural bitumen | 1.2–1.4 |
| cotton flock | 1.3–1.4 |
| cellulose flock | 1.15–1.5 |
| leather fiber | 1.2–1.4 |

When the end of the hollow channel at the outer edge of the core has a shoulder, the plug is formed so that it fits into the end of the hollow channel at the shoulder. The plug can be formed so that its outer edge is flush with the outer surface of the core, as shown in FIGS. 1–5. Alternatively, the plug can be formed to enclose the end of the hollow channel with a portion of the plug extending beyond the outer edge of the core, as shown in FIG. 8.

The shape of the plug can vary. Generally, the plug has a shape similar to the shoulder. When the shoulder has generally cylindrical ends, as shown in FIGS. 16 and 17, the plug has a generally cylindrical shape. Alternatively, when the shoulder has an angled or conical shape, as shown in FIG. 7, the plug has a similar shape in order to enclose the shoulder, and thus, the end of the hollow channel.

Solid cores are typically compression molded from a slug of uncured or lightly cured elastomer composition comprising a high cis content polybutadiene and a metal salt of an α, B-ethylenically unsaturated carboxylic acid such as zinc mono-or diacrylate or methacrylate. To achieve higher coefficients of restitution in the core, the manufacturer may include fillers such as small amounts of a metal oxide such as zinc oxide. In addition, lesser amounts of metal oxide can be included in order to lighten the core weight so that the finished ball more closely approaches the USGA® upper weight limit of 1.620 ounces.

Other materials may be used in the core composition including compatible rubbers or ionomers, and low molecular weight fatty acids such as stearic acid. Free radical initiators such as peroxides are admixed with the core composition so that on the application of heat and pressure, a complex curing cross-linking reaction takes place.

In a preferred embodiment, the core composition comprises at least one highly neutralized ionomer containing high levels of fatty acids or metal salts of fatty acids. The highly neutralized ionomer containing high levels of fatty acids or metal salts of fatty acids are very durable materials, especially when molded into a neat sphere to form a core. Generally, the highly neutralized ionomers containing high levels of fatty acids or metal salts of fatty acids have a higher C.O.R. than a similar core formed of traditional materials such as polybutadiene. The C.O.R. of the core is generally at least 0.800, preferably greater than 0.810, and more preferably greater than 0.820. The specific gravity is generally less than 1.0. The highly neutralized ionomers containing high levels of fatty acids or metal salts of fatty acids may be used filled or unfilled, but it is preferable if it is unfilled as it has better properties such as durability and C.O.R. Using a highly neutralized ionomer containing high levels of fatty acids or metal salts of fatty acids would also allow the use of heavier weights or magnets, thereby increasing the initial moment of inertia of the golf ball.

Examples of commercially available highly neutralized ionomers containing high levels of fatty acids or metal salts of fatty acids include HPF materials available from DuPont. Additionally, the materials may be produced using methods known in the art, and other materials, such as the materials described for use as cover materials may be used for golf ball cores, such as those described in U.S. Pat. Nos. 5,306,760; 5,312,857; 5,542,677; 5,591,803; 6,100,336; 6,350,815; 6,469,102; and 6,743,847, all of which are hereby incorporated by reference, may be utilized in whole or in part.

It will be understood that a wide array of other core configurations and materials could be utilized in conjunction with the present invention. For example, cores disclosed in U.S. Pat. Nos. 5,645,597; 5,480,155; 5,387,637; 5,150,9136; 5,588,924; 5,507,493; 5,503,397; 5,482,286; 5,018,740; 4,852,884; 4,844,471; 4,838,556; 4,726,590; and 4,650,193; all of which are hereby incorporated by reference, may be utilized in whole or in part.

Figure 18:
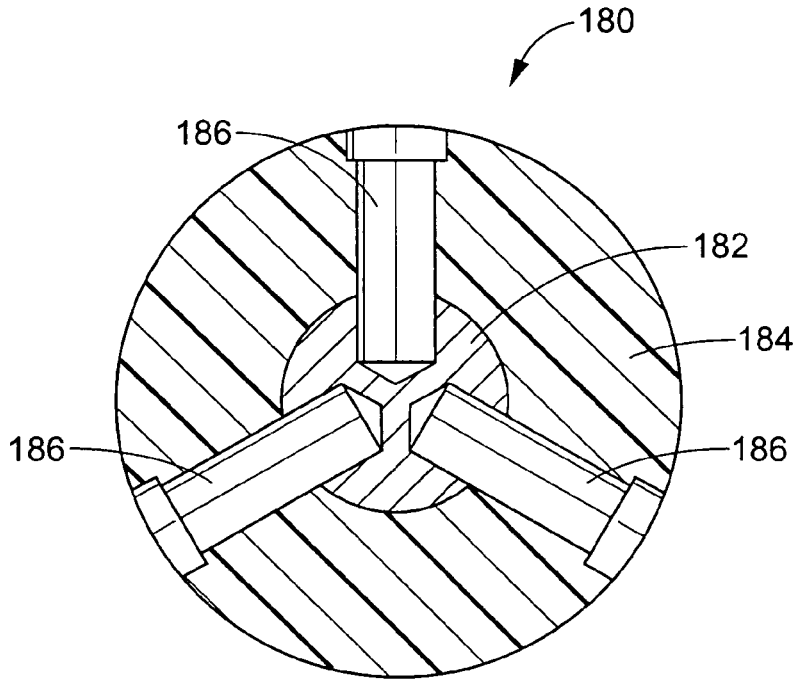
FIG. 18 depicts a cross-sectional view of a multi-layer core having an inner core layer and outer core layer, the multi-layer core defining three hollow channels.

The core comprises a single or multiple layers. FIG. 18 shows a multi-layer core 180 having an inner core layer 182 and an outer core layer 184 disposed about the inner core layer 182. The multi-layer core 180 defines one or more hollow channels 186. Compositions for multi-layer cores are further disclosed in U.S. Pat. Nos. 6,057,403 and 6,213,895, entirely incorporated by reference.

A core and mantle or interior layer may be used to further define a hollow channel. Core and mantle layers suitable for the present invention are disclosed in U.S. Pat. Nos. 6,193,618; 6,309,312; and 6,244,977, as well as those previously described. The hollow channel extends inwardly from the outer edge of the mantle layer, through the mantle layer, and into the core. The end of the hollow channel may have its end near the center of the core, or alternatively, extend through the core and have its second end at the outer edge of the mantle layer.

Figure 19:
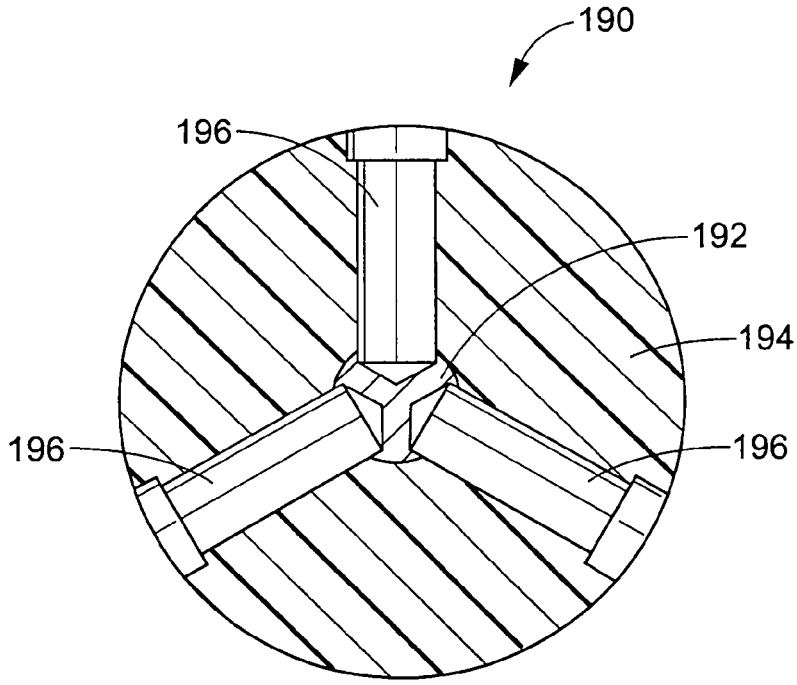
FIG. 19 depicts a cross-sectional view of a multi-layer core having an inner core layer comprising a metal spherical center and an outer core layer, the multi-layer core defining three hollow channels.

A core comprising a metal spherical center and a layer disposed about the center can define a hollow channel. FIG. 19 shows a golf ball 190 having a metal spherical center 192 and a core 194 disposed about the metal spherical center 192. The metal spherical center 192 defines the ends of the hollow channels 196 near the center. Preferably, the metal spherical center 192 comprises tungsten. Cores having a metal spherical center and a layer disposed about the metal ball center are disclosed in U.S. patent application Ser. No. 09/394,829, issued as U.S. Pat. No. 6,277,034.

The cover used in the present golf ball may utilize any cover composition and/or configuration known in the art. The cover may be a single or multi-layer cover. Single cover layer golf ball compositions for use in the present invention include those disclosed in U.S. Pat. Nos. 6,126,559; 6,120,393; 5,971,872; 5,833,553; 5,820,489; 5,803,831; 5,733,207; 5,645,497; 5,580,057; 5,507,493; 5,470,075; and 5,368,304, entirely incorporated herein by reference.

Multi-layer covers and compositions for use in the present golf ball include those disclosed in U.S. Pat. Nos. 6,224,498; 6,220,972; 6,213,894; 6,210,293; 6,204,331; 6,152,834; 6,149,536; 6,083,119; 6,042,488; 5,971,871; 5,873,796; and 5,830,087, entirely incorporated herein by reference.

The preferred method of making the present golf ball includes the following steps. First, at least one hollow channel is radially formed in the golf ball core. The channel may be formed by drilling from the outer edge of the golf ball core into the core near the center at a predetermined length. A shoulder can be formed at the end of the hollow channel near the outer edge of the core by a countersink drilling operation. Alternatively, two halves of a core may be formed having recesses wherein the two halves are combined in order to form a golf ball core having one or more channels and optional shoulder. Or, the channels may be "molded in" using retractable non-stick coated (i.e., Teflon® coated) pins during core molding. Once the channels are formed, at least one movable weight is inserted into each channel. An optional spring or spring-like device is inserted into the hollow channel and is attached to be in continuous contact with the weight. A plug is then inserted to cover the end of the hollow channel.

The spring may be inserted before the movable weight so the weight is between the spring and plug or inserted into the hollow channel after the insertion of the movable weight, so that the spring is positioned between the weight and plug. The spring or spring-like device may be connected to the core, weight, or plug. It is noted that if the weights and plugs comprise a magnet, the spring or spring-like device is not required.

Alternatively, multi-layered cores, mantle cores and finished golf balls may also be drilled for inserting movable weights and springs. The finished balls may then be plugged by using materials which normally form the outer layer of a golf ball. The plugs may be ultrasonically-bonded or spin-bonded.

The following examples illustrate various aspects of the present invention. The examples are provided for the purposes of illustration and are in no way intended to limit the scope of the invention.

EXAMPLES

Example 1

Cores having a diameter of 1.545 inches were formed having the following formulation (amounts of ingredients are in parts per hundred rubber (phr) based on 100 parts butadiene rubber):

TABLE 1

| Core Stock | |
|---|---|
| Composition | Formulation |
| BCP - 820 polybutadiene | 40 |
| Neo Cis ® 40 polybutadiene | 30 |
| Neo Cis ® 60 polybutadiene | 30 |
| Zinc oxide | 5 |
| Zinc Stearate | 5 |
| Zinc Diacrylate | 35 |
| Luperco ® 231 XL Peroxide | 0.40 |

The cores were subsequently drilled at five equally-spaced locations on the equator using a 0.25 inch width drill bit to form five radially extending hollow channels. The five equally spaced hollow channels extended inwardly to near the center of the core but the center of the core was maintained. The mass of the core was measured as follows.

| | |
|---|---|
| Weight of core before drilling | 36.894 grams |
| Weight after five (5) holes drilled | 33.529 grams |
| Change in weight | 3.365 grams |

A steel spherical ball for use as the moveable weight was inserted into each hollow channel. Each weight had a diameter of 0.219 inches and the total weight of the steel balls was 3.497 grams.

A compression spring having a length of 1 inch, a load of 0.38 lbs., a deflection of 0.82 inches at load, and a rate of 0.48 lbs./in. was cut into two 0.50 inch springs. A 0.50 inch spring was inserted into each hollow channel. The total weight of the five springs equaled 0.28 grams.

The five holes of the hollow channels on the surface of the core were enclosed with a plug formed from crosslinked core stock. The plug was inserted into the end of the hollow channel and was secured with epoxy resin. After curing, the surface was sanded and smoothed.

The core was placed on a battery-powered spin tester and oriented such that the plane within which the five hollow channels, springs, and movable weights are disposed generally extended vertically. The axis of rotation of the spin tester was vertical. The core was then spun. At near maximal spin rate, the core changed its orientation so that the plane having the five hollow channels, springs, and moving weights was perpendicular to the spin axis. The change in orientation of the golf ball core occurred at a spin rate of about 2500 rpm. The springs maximally compressed at 4800 rpm. The maximal speed of the spin tester is 7941 rpm.

For comparison, a control core was used having five hollow channels in the core but no weights or springs disposed within those channels. The core was inserted into the spin tester so that the plane having the five hollow channels was substantially vertical. The comparison core, when spun, maintained its vertical orientation and did not shift to a horizontal orientation at any spin rate.

Example 2

Cores were molded having the following formulation (amounts of ingredients are in parts per hundred rubber (phr) based on 100 parts butadiene rubber):

TABLE 2

| Core Stock | |
|---|---|
| Composition | Formulation |
| BCP - 820 polybutadiene | 40 |
| Neo Cis ® 40 polybutadiene | 30 |
| Neo Cis ® 60 polybutadiene | 30 |
| Zinc oxide | 5 |
| Zinc Stearate | 5 |
| Zinc diacrylate | 35 |
| Luperco ® 231 XL Peroxide | 0.40 |

The slugs formed from the above formula, which were used to form cores, had a slug weight of 38.5 to 39.0 grams. The cores were semi-translucent and had the following properties:

TABLE 3

| | |
|---|---|
| Diameter (as measured along the poles) | 1.531 inches |
| Diameter (as measured along the equator) | 1.533 inches |
| Weight | 34.265 g |
| Riehle Compression | 61.3 |
| Coefficient of Restitution (C.O.R.) | 0.832 |
| Plaque Shore D Hardness | 53 |

Hollow channels were drilled into the cores with a 0.25 inch diameter counterbore tip drill. The hollow channels had a length of 0.600 inches and a 0.375 inch diameter countersink region at the end of the outer edge of the core forming a shoulder. The weight loss of the hollow channels and countersink equaled 3.47 grams per core.

The ends of the hollow channels on the surface of the core were then enclosed with plugs having the formulation disclosed in Table 4. The plug composition was cured before the ends of the hollow channels were enclosed by the plugs.

TABLE 4

| Plug/Disk Stock | |
|---|---|
| BCP - 820 polybutadiene | 40 |
| Neo Cis ® 60 polybutadiene | 30 |
| Neo Cis ® 40 polybutadiene | 30 |
| Zinc oxide | 50 |
| Zinc stearate | 5 |
| Zinc diacrylate | 35 |
| Tungsten | 140 |
| Luperco ® 231 XL Peroxide | 4.0 |
| TOTAL: | 334 |

The plug composition exhibited a specific gravity of 2.223.

Two identical cores were assembled having five hollow channels and a shoulder at the end of the hollow channel along the outer edge of the core. Both cores were assembled with plugs having the above formulation, 0.50 inch springs, and 0.219 inch diameter steel balls. The first plug was molded into the plaques mold wherein the plug was molded at about 0.110 inches thick. The second core used the same stock but was reinforced with an aluminum window screen mesh molded on both sides of the plug stock in the plaque mold. The plug including the mesh had a thickness of about 0.130 inches. The disks were cut to size with a 0.375 inch plug cutter. Table 5 below compares the two cores.

TABLE 5

| With 0.375 inch Plug Cutter | #1 No Aluminum Mesh in Plug | #2 Aluminum Mesh in Plug |
|---|---|---|
| Weight before with 5 holes & countersink | 30.311 g | 30.527 g |
| Weight assembled but plug not sanded | 36.36 g | 36.64 g |
| Weight sanded | 36.23 g | 36.40 g |
| Weight injection-molded cover | 45.79 g | 45.84 g |
| Diameter (pole) | 1.692 inches | 1.693 inches |
| Diameter (equator) | 1.685 inches | 1.685 inches |

Core #2 having the aluminum mesh plug was tested for its coefficient of restitution. Table 6 below shows the results:

TABLE 6

| Core #2 fired for C.O.R. | C.O.R. |
|---|---|
| 1st firing | 0.802 |
| 2nd firing | 0.802 |
| 3rd firing | 0.798 |
| 4th firing | 0.745 |

After four firings, the core was spun in a spin tester and continued to find the correct axis. The core was cut in half and sanded. The springs and steel balls were still functional.

TABLE 7-continued

| Core Stock | |
|---|---|
| Composition | phr |
| HI-SIL ® 233 | 3 |
| Zinc stearate | 5 |
| Zinc diacrylate | 30 |
| Yellow/Green M.B. | 0.1 |
| Luperco ® 231 XL Peroxide | 0.9 |
| TOTALS: | 144 |

The slug weight of the above composition was 38–39 grams. Cores were formed from the slugs with the following properties:

TABLE 8

| | |
|---|---|
| Size | 1.542 inches |
| Weight | 34.05 grams |
| Riehle Compression | 82 |
| Coefficient of Restitution (C.O.R.) | 0.804 |

The cores were centerless ground. The size of the core was 1.503 inches and the weight was 31.78 grams.

Six cores were drilled with a counterbore so that each core had five hollow channels and shoulders at the end of the hollow channel at the outer edge of the core. The weight loss due to the drilling of the hollow channels was 3.39 grams so that the core after drilling five hollow channels weighed 28.39 grams.

Another six cores were drilled with a counterbore so that each core had three hollow channels and shoulders at the end of the hollow channel at the outer edge of the core. The weight of the core after three hollow channels and shoulders were drilled was 29.65 grams. Different moving weights and springs were inserted into the three hollow channels and five hollow channel cores as shown in Table 9 below.

TABLE 9

| | CORES FROM PREVIOUS PAGE WERE INJECTION MOLDED USING T.G. WHITE COVER STOCK | DOT CODE | SIZE POLE | Diameter (equator) | Weight |
|---|---|---|---|---|---|
| A | 5 balls having 5 holes/springs & 5 steel balls | 1 blue | 1.697 in. | 1.687 in. | 45.76 g |
| B | 1 ball having 5 holes/springs & 5 brass balls | 2 blue | 1.696 in. | 1.687 in. | 46.1 g |
| C | 5 balls having 3 holes/springs & 3 steel balls | 1 red | 1.688 in. | 1.686 in. | 44.4 g |
| D | 1 ball having 3 holes/springs & 3 brass balls | 2 red | 1.689 in. | 1.686 in. | 44.6 g |
| E | 3 balls control same centers - no holes | 1 black | 1.681 in. | 1.679 in. | 42.4 g |

Example 3

Core slugs were formed having the following formulation:

TABLE 7

| Core Stock | |
|---|---|
| Composition | phr |
| CB-10 polybutadiene | 100 |
| Zinc oxide | 5 |

Covers having similar formulations to the covers used in TOP-FLITE® XL golf balls were injected-molded onto each core.

Each steel ball used above had a diameter of 0.219 inches and a mass of 0.699 grams. The brass balls used above had a diameter of 0.219 inches and a mass of 0.772 grams. The springs exhibited the same properties as the springs used in Example 1.

The plugs enclosing the ends of the hollow channel at the outer surface of the core employed the same plug formulation as in Example 2. Each plug had a diameter of 0.365 inches, a thickness of 0.125 inches and a mass of 0.489 grams.

Golf ball Type A above was fired at 125 feet per second (C.O.R. speed). The C.O.R. was 0.793. Calculated typical values of a golf ball having a variable M.O.I. are shown below in Table 10.

TABLE 10

| Description | Value |
|---|---|
| Moving Weight Diameter | 0.219 inches |
| Moving Weight Mass | 0.450 inches |
| Initial Radial Position of Moving Weight Relative to Golf Ball Center | 0.150 inches |
| Maximum Radial Position of Moving Weight Relative to Golf Ball Center | 0.400 inches |
| Radial Dimension of Outboard End of Spring | 0.725 inches |
| Spring Stiffness | 0.389 lb/in |
| Free Height of Spring (unloaded) | 0.476 inches |
| Solid Height of Spring (completely compressed) | 0.216 inches |
| Spin Rate Required to Overcome Spring Pre-Load | 1000 rpm |
| Spin Rate Required to Compress Spring to Solid Height | 3000 rpm |
| Number of Moving Weights in Golf Ball | 5 |
| Mass Moment of Inertia of Golf Ball When Ball Bearings Are at R1 | 0.450 oz/in$^2$ |
| Mass Moment of Inertia of Golf Ball When Ball Bearings Are at R2 | 0.461 oz/in$^2$ |
| Centrifugal Force on Moving Weight @ 1000 rpm | 0.004 lb |
| Centrifugal Force on Moving Weight @ 3000 rpm | 0.101 lb |
| Height of Spring when Moving Weight is at R1 | 0.466 in |
| Height of Spring when Moving Weight is at R2 | 0.216 in |
| Total Deformation in Spring When Moving Weight Is at R1 | −0.011 in |
| Total Deformation in Spring When Moving Weight Is at R2 | −0.261 in |
| Force on Moving Weight from Spring at R1 | −0.004 lb |
| Force on Moving Weight from Spring at R2 | −0.101 lb |
| Spring Stiffness (or Spring Rate) | 0.389 lb/in |

Golf ball Type C above was fired 21 times and did not break. The average C.O.R. was 0.786 with the minimum C.O.R. measuring at 0.763 and the maximum C.O.R. measuring at 0.799. The standard deviation was 0.011. The difference in C.O.R. was due to hitting the ball on the pole (i.e., no holes) versus on the equator (with holes, springs, balls, and plugs).

Example 4

Two types of test balls were made using the method previously described. One type had three channels, each containing one 0.250 inch diameter lead shot weighing 1.56 grams and one compression spring having a load rating of 0.38 pounds deflection. The second type had two channels, each containing one 0.230 inch diameter tungsten metal ball weighing 1.92 grams and one compression spring having a load rating of 0.38 pounds deflection. These balls were finished and tested on a mechanical golfing machine (Iron Byron) using a Top-Flite® Intimidator Driver at 132 feet per second club head speed. The machine was set up to produce a high pull slice on the control golf ball. All balls were placed on the tee randomly with regard to pole and equator orientation. Both of the test balls reduced slices from 43 to 47% compared to the conventional solid two piece control ball.

Example 5

A ball according to FIG. 10 and using two movable magnetic weights arranged to be attracted to one another (opposite poles facing each other), was prepared as follows. Two cylindrical permanent magnets, each ¼ inch in diameter and ¼ inch in length, and weighing 1.45 grams each, were placed in corresponding radial channels in a golf ball core. Each channel had a diameter of 17/64 inches and were oriented 180° apart. The central barrier thickness between the channels was 0.70 inches. The bottom or innermost portion of each channel was reamed flat. The two magnets exhibited a pull of 0.313 pounds. Upon insertion of the magnets, the channels were sealed with a disc-like cover. Spin tests revealed that the magnets readily separated at a low RPM, and returned toward the center of the ball upon the ball coming to rest.

As will be apparent to persons skilled in the art, various modifications and adaptations of the structure above described will become readily apparent without departure from the spirit and scope of the invention, the scope of which is defined in the appended claims.

What is claimed is:

1. A golf ball having a controlled variable moment of inertia comprising:

a core, said core having an interior and an outer periphery and defining at least one hollow channel radially extending between a first opening defined along said outer periphery of said core and a location within the interior of said core, wherein said core comprises a highly neutralized ionomer containing high levels of fatty acids or metal salts thereof;

at least one movable weight disposed in said hollow channel;

a placement member disposed in said hollow channel, said placement member in continuous contact with said movable weight; and a plug disposed in said first opening thereby enclosing said hollow channel.

2. The golf ball according to claim 1, wherein said placement member is a spring disposed in said hollow channel and positioned between said movable weight and said plug.

3. The golf ball according to claim 2, wherein said spring and said plug are secured to each other.

4. The golf ball according to claim 1, wherein said outer periphery of said core defining said first opening of said hollow channel further defines a shoulder proximate said first opening, said shoulder having a span opening greater than the width of said hollow channel.

5. The golf ball according to claim 4, wherein said plug is disposed in said shoulder.

6. The golf ball according to claim 1, wherein said movable weight is formed of a metallic material selected from the group comprising brass, steel, iron, copper, nickel and tungsten.

7. The golf ball according to claim 1, wherein said movable weight has a specific gravity of at least 2.0.

8. The golf ball according to claim 5, wherein the outer surface of said plug is flush with said outer surface of said core.

9. The golf ball according to claim 1, wherein said plug further comprises a metallic mesh.

10. The golf ball according to claim 1, wherein said golf ball further comprises a cover disposed on said core.

11. A golf ball comprising:

a core, said core defining at least one hollow channel radially extending between a first end disposed adjacent to the outer periphery of said core and a second end disposed proximate the center of said core, wherein said core comprises a highly neutralized ionomer containing high levels of fatty acids or metal salts thereof;

at least one movable weight disposed in said hollow channel, said movable weight comprising a first magnet; and a plug comprising a second magnet, said plug disposed at said first end of said hollow channel.

12. The golf ball according to claim 11 wherein said movable weight defines a first face directed radially toward said outer periphery of said core and a second face directed radially toward the center of said core, said plug defines a first face directed radially toward said center of said core, and said movable weight and said plug are oriented such that said first face of said movable weight is directed toward said first face of said plug.

13. The golf ball according to claim 11, wherein said golf ball further comprises a spring disposed in said hollow channel, said spring disposed between said movable weight and said plug.

14. The golf ball according to claim 11, wherein said first end of said hollow channel further defines a shoulder having a span opening greater than the width of said hollow channel.

15. A golf ball comprising:

a core, said core having a center and an outer surface, said core defining at least one hollow channel extending between a first end at said outer surface of said core and a second end at a location proximate said center of said core, wherein said core comprises a highly neutralized ionomer containing high levels of fatty acids or metal salts thereof;

a spring disposed in said hollow channel;

a plug secured to said first end of said hollow channel thereby enclosing said hollow channel; and at least one movable weight disposed between said spring and said plug.

16. The golf ball according to claim 15, wherein said movable weight and said spring are in continuous contact with each other.

17. The golf ball according to claim 15, wherein said spring is secured to an interior wall of said hollow channel.

18. The golf ball according to claim 15, wherein said first end of said hollow channel further defines a shoulder having a width greater than the width of said hollow channel, wherein said plug is disposed in said shoulder.

* * * * *